US006570135B2

(12) United States Patent
Gros et al.

(10) Patent No.: US 6,570,135 B2
(45) Date of Patent: May 27, 2003

(54) KITCHEN STOVE FOR PREPARING FOOD, AND AN OVEN FOR PREPARING FOOD

(75) Inventors: Oliver Gros, Rheinböllen (DE); Peter Nass, Mainz (DE)

(73) Assignee: Schott Glas, Mainz (DE)

( * ) Notice: Subject to any disclaimer, the term of this patent is extended or adjusted under 35 U.S.C. 154(b) by 0 days.

(21) Appl. No.: 09/990,590

(22) Filed: Nov. 21, 2001

(65) Prior Publication Data

US 2002/0079306 A1 Jun. 27, 2002

(30) Foreign Application Priority Data

Nov. 21, 2000 (DE) ..... 100 57 604

(51) Int. Cl.[7] ..... A21B 1/14; A21B 3/02; F24C 15/04; H05B 3/26

(52) U.S. Cl. ..... 219/396; 219/397; 219/398; 219/411; 126/200

(58) Field of Search ..... 219/396, 391, 219/395, 397, 398, 411, 413; 126/190, 200

(56) References Cited

U.S. PATENT DOCUMENTS 5,588,421 A * 12/1996 Busch et al. ..... 126/200

FOREIGN PATENT DOCUMENTS

| | | |
|---|---|---|
| DE | 4209622 | 9/1983 |
| DE | 8716665 | 3/1988 |
| DE | 3644276 | 7/1988 |
| DE | 29922756 | 4/2000 |

* cited by examiner

*Primary Examiner*—Joseph Pelham
(74) *Attorney, Agent, or Firm*—Nils H. Ljungman & Associates

(57) ABSTRACT

There is now provided a kitchen stove for preparing food, and an oven for preparing food. The stove or oven has a heating arrangement to make the cleaning of the stove or oven easier for a user particularly at the viewing window of the oven.

20 Claims, 16 Drawing Sheets

KITCHEN STOVE FOR PREPARING FOOD, AND AN OVEN FOR PREPARING FOOD

BACKGROUND OF THE INVENTION

1. Field of the Invention

One aspect of the invention relates to a kitchen stove for preparing food, another aspect of the invention relates to an oven for preparing food.

2. Background Information

In general terms, a stove for cooking food comprises a stove body, with the stove body being configured with a base and the stove body further being configured with an interior chamber confined by top and bottom walls, side walls, a rear wall, and a front.

An oven is disposed in the interior chamber of the stove body and the oven comprises a heating arrangement configured and disposed to provide heating to cook food in the oven. There is further provided control apparatus to control the heating arrangement.

The oven usually comprises a door in the front wall, which door may comprise a window arrangement, with the window arrangement comprising a viewing area to view the interior of the oven.

U.S. Pat. No. 5,432,321 issued to Gerl on Jul. 11, 1995, discloses an oven which includes a normal heating device, a partial heating capacity device, a first indicator device associated with the normal heating device, a second indicator device associated with the partial heating capacity device, and a control unit.

The control unit turns on a full heating capacity of the normal heating device in a preheating phase and turns on the first indicator device to indicate that the normal heating device is on. The control unit turns on the partial heating capacity device in the preheating phase and turns on the second indicator device to indicate the preheating phase.

The control unit automatically switches over the normal heating device to a reduced heating capacity in a continued heating phase, when a selected command temperature is reached. The control unit turns off the partial heating capacity device and automatically turns off the second indicator device simultaneously with the switchover to the continued heating phase.

U.S. Pat. No. 5,928,540, issued to Antoine et al. on Jul. 27, 1999, refers to an oven door for closing a cooking chamber of an oven, the door being composed of: a frame on the oven; an inner wall and an outer wall both supported by the frame so that the inner wall is located between the cooking chamber and the outer wall, the inner wall and outer wall being positioned relative to one another to delimit an air space; and ventilation elements for establishing a flow of air between the inner wall and the outer wall in order to maintain the outer wall at a low temperature during a cooking operation, wherein the inner wall is made of glass, and the outer wall is removable from the frame and is made of a plastic material selected to withstand the temperatures to which it will be exposed during any cooking operation.

The window arrangement referred to above may comprise a plurality of panes, for example, a first pane and a second pane, with the second pane being disposed adjacent to the first pane, and the first pane being disposed to face towards the interior of the oven upon installation in the stove.

The surface of a continuous clean oven is impregnated with a special porous surface that oxidizes splashes, spatters, etc. of food. Unfortunately, the oven only cleans when the oven is used, and experience teaches owners that their ovens do not stay clean unless they use the oven almost continuously.

The best way to clean a continuous clean oven is to turn it on at 350 or 400 degrees Fahrenheit and leave it on for two or three hours at a time to speed the cleaning process. This results in being similar to a self-cleaning oven. Using a regular oven cleaner can leave residue in the porous surface, and damage the oven lining.

In self-cleaning electric ranges, the oven temperature rises to approximately 875 degrees Fahrenheit (468 degrees Celsius), the temperature needed to burn off food soil.

When the temperature reaches approximately 560 degrees Fahrenheit (293 degrees Celsius), the oven door locks automatically and the lock light comes on. At the end of the cleaning cycle, the oven turns off automatically. When the oven has cooled down to approximately 520 degrees Fahrenheit (271 degrees Celsius), the lock is released, the locked light goes out, and the oven door can be opened.

The invention, in one aspect, relates to a viewing window for baking ovens with self-cleaning pyrolytic arrangements, such window having at least two transparent panes, that is, an inner pane facing the muffle of the baking oven, with this pane being made of temperature-resistant glass or glass ceramic, and an outer pane arranged at a distance from the inner pane.

A viewing window of this type is known from Federal Republic of Germany Patent Publication No. 42 09 622 A1, corresponding to U.S. Pat. No. 5,337,727, issued to Borens, et al. on Aug. 16, 1994, and entitled,"Window for a device with elevated inner chamber temperature."

Viewing windows for baking ovens typically have at least two panes which are disposed at a distance from one another, that is, an inner pane, which is facing towards the baking oven, and an outer pane, which is subjected to the ambient temperature.

The inner pane is subjected to the temperature and vapors of the baking oven. Thus, it is configured of temperature-resistant, transparent materials, typically glass or glass ceramic, and it is subjected to soiling arising during baking and broiling processes.

Cleaning of the muffle of the baking oven and of the inner pane is to be done manually in a cumbersome manner in standard appliances.

More advanced baking oven appliances, so-called pyrolytic appliances, have an arrangement for self-cleaning which burns off the dirt adhering at the oven interior by way of high temperatures of the interior space of approximately 500 degrees Celsius. The residues which are in the form of ashes can then be wiped away with a cloth.

The self-cleaning mechanism of such pyrolytic appliances is effective on the surface of the muffle, on the one hand, and at the center of the inner pane, on the other hand. Particularly at the edge of the inner pane, in the region of the seal of the muffle, however, a remainder of dirt is often remaining, which dirt is not combusted due to too low temperatures in the peripheral region, but instead is rather consistently burnt-in which hampers a complete cleaning. So as to counteract this effect, the afore-mentioned patent publication of the Federal Republic of Germany provides a heat-reflecting outer coating on the inner pane. This coating, however, can only diminish the heat loss, that is, it can not serve to prevent the remaining dirt residue.

OBJECT OF THE INVENTION

One object of one embodiment of the present invention addresses the problem of configuring the viewing window for baking ovens defined in the introduction in such a way that cleaning of the window is made significantly easier upon use of the baking oven.

SUMMARY OF THE INVENTION

In accordance with one aspect of the invention, this object may be accomplished by a kitchen stove for preparing food, such as, cooking, roasting, boiling, grilling, broiling, and baking food, said stove comprising: a stove body; said stove body being configured with a support to support said stove body; at least one heating arrangement to cook food; said at least one heating arrangement being disposed atop said stove body; said at least one heating arrangement comprising (i.), (ii.), and (iii.): (i.) an arrangement to receive a bottom of a cooking utensil; (ii.) at least one first heating element means to cook food; and (iii.) a first apparatus to select and set a heat setting of said at least one first heating element means; said at least one first heating element means being disposed under said receiving arrangement and being configured to pass heat through said receiving arrangement to a bottom of a cooking utensil; said first heat setting apparatus being configured to select and set a heat setting of said at least one first heating element means at a heat sufficient to cook food; said stove body being configured with a cooking oven; said cooking oven being configured to cook, roast, boil, grill, broil, and bake food; said cooking oven being configured with an interior confined by walls comprising top and bottom walls, side walls, a rear wall, and a front; a second heating arrangement comprising (i.) and (ii.): (i.) at least one second heating element means to cook food; and (ii.) a second apparatus to select and set a heat setting of said at least one second heating element means; said at least one second heating element means being disposed to heat said interior of said cooking oven and being configured to cook, roast, boil, grill, broil, and bake food; said second heat setting apparatus being configured to select and set a heat setting of said second heating element means to a heat sufficient to cook, roast, boil, grill, broil and bake food; a third heating arrangement comprising (i.) and (ii.): (i.) a third heating element means; and (ii.) a third apparatus to set a heat setting of said third heating element means; said third heating element means being disposed to heat said interior of said cooking oven and being configured to heat said interior of said cooking oven to transform cooking residue, deposited in said interior of said cooking oven upon preparing food in said cooking oven, into ash; said third heat setting apparatus being configured to set a heat setting of said third heating element means at a sufficient heat for a time sufficient to transform cooking residue, deposited in said interior of said cooking oven upon preparing food in said cooking oven, into ash; said front comprising an oven door; said oven door being configured to permit access to said interior of said cooking oven; said oven door comprising a window arrangement configured with a viewing area to view food being prepared in said cooking oven; said window arrangement comprising (i.) and (ii.): (i.) a first door window pane; and (ii.) a second door window pane disposed at a distance from said first door window pane; an arrangement to maintain said first door window pane disposed at a distance from said second door window pane; said first door window pane becoming an inner door window pane upon closing of said oven door; said first door window pane having a first, inner, surface disposed towards said interior of said cooking oven upon closing of said oven door; said second door window pane becoming an outer pane upon closing of said oven door; and a fourth heating arrangement comprising (i.) and (ii.): (i.) a fourth heating element means; and (ii.) a fourth apparatus to set a heat setting of said fourth heating element means; said fourth heating element means being disposed on or in said first door window pane and being configured to assist in heating by said third heating element means of said first window pane; said fourth heating element means further being disposed and configured to assist said third heating element means to transform cooking residue, deposited on said first, inner, surface of said first door window pane upon preparing food in said cooking oven, into ash; said fourth heat setting apparatus being configured to set a heat setting of said fourth heating element means at a sufficient heat for a time sufficient to transform cooking residue, deposited on said first, inner, surface of said first door window pane (30) upon preparing food in said cooking oven, into ash, thus at least to assist said third heating element means to transform cooking residue on said first door window pane, into ash.

In accordance with a further aspect of the invention there is also provided a method of cleaning an oven for preparing food, said oven comprising: an oven structure; said oven structure being configured to prepare food; said oven structure comprising an oven body being configured with an interior confined by walls comprising top and bottom walls, side walls, a rear wall, and a front; said front comprising an oven door; said oven door being configured to permit access to said interior of said oven; said oven door comprising a window arrangement configured with a viewing area to view food being prepared in said oven; said window arrangement comprising at least one door window pane; said at least one door window pane comprising a first door window pane; said first door window pane having a first, inner, surface disposed towards and in said interior of said oven upon closing of said oven door; and a heating arrangement comprising (i.) and (ii.): (i.) a heating element means; and (ii.) an apparatus means to set a heat setting of said heating element means; said heating element means being disposed on, in, or sufficiently adjacent to said first door window pane to heat said first door window pane; said heating element means being configured to heat said first door window pane to transform a first, cooking, residue, deposited on said first, inner, surface of said first door window pane upon preparing food in said oven, into a second, converted, residue; said heat setting apparatus means being configured to set a heat setting of said heating element means at a sufficient heat for a time sufficient to transform the first, cooking, residue, deposited on said first, inner, surface of said first door window pane upon preparing food in said oven, into the second, converted, residue; said method comprising the steps of: disposing food in said interior of said oven; preparing food in said oven; depositing a first, cooking, residue from cooked food on said first, inner, surface of said first door window pane; removing prepared food from said oven; setting said heat setting apparatus means to a heat sufficient to transform the first, cooking, residue, deposited on said first, inner, surface of said first door window pane upon preparing food, into a second, converted, cooking residue more readily removable from said interior of said oven than the first, cooking, residue; setting said heat setting apparatus means to a heat sufficient to transform the first, cooking, residue, deposited on said first, inner, surface of said first door window pane upon preparing food, into a second, converted, cooking residue more readily removable from said first, inner, surface of said first door window pane than the first, cooking, residue; and removing the second, converted, cooking residue from said first, inner, surface of said first door window pane.

The solution of one aim or object is accomplished with a viewing window for baking ovens with a self-cleaning pyrolytic arrangement, such a window having at least two transparent panes, that is, an inner pane facing the muffle of the baking oven, with this pane being made of temperature-resistant glass or glass ceramic, and an outer pane arranged at a distance from the inner pane, in accordance with the invention thereby that the inner pane is configured with an electric heating arrangement for a pyrolytic self-combustion or spontaneous combustion.

The installation of such an inner pane, which is actively heated, the temperature of the pane is sufficiently raised such that also in the region of the seal there is attained a sufficiently high pyrolysis temperature. By way of this, the dirt disposed on the pane is dissolved and any residue remaining under the circumstances can be wiped off using cleansers customarily used in a household.

The heating of viewing windows for cooking spaces in active manner is known per se. In the case of Federal Republic of Germany Petty Patent No. 299 22 756 U1, heating is done to achieve a uniform warming of the material to be brought to a cooked condition. In the case of Federal Republic of Germany Patent Publication No. 87 16 665, fogging of windows is to be precluded.

The realization of the electric heating arrangement is possible in several embodiments.

In accordance with a first further configuration the viewing window can be configured in such a way that the electric heating arrangement is configured by a transparent, electrically conductive layer which layer can be heated in resistive manner by way of a source of current.

Such layer can be applied in relatively simple manner to be long lasting.

It is preferred that the layer is provided on that side of the inner pane which side is facing away from the muffle, such that it will not be subjected to various vapors of the baking oven. The layer can, however, also be directed towards the muffle of the oven.

It is within the scope of the invention that the layer is provided only in predetermined regions of the inner pane, particularly in the edge region of the inner pane, to thus configure the heating in selective manner, since due to the temperature drop in the peripheral region, the self-cleaning is poorer when compared to the central portion.

Alternatively, it is within the scope of the invention that the layer is provided fully over the surface of the inner pane and, for the purpose of making contact with the layer with a source of current, on both narrow sides, respectively, one strip conductor is arranged.

So as to avoid the danger of an electric arcing to the metallic frame of the viewing window or, respectively, the door, this frame is usefully configured in such a way that between the outer periphery of the layer and the edge of the inner pane there is formed a free space that is not coated.

In accordance with one feature of the invention, the electric arrangement is configured in such a way that the electric connection of the layer with the source of current is accomplished by way of applied contact strips, or by contacts that are pressed-on in a resilient manner, or by way of cables that are secured by soldering.

The inner pane can additionally be furnished with decorations. In accordance with one embodiment there is provided that the decorations are configured as conductive enamel-decorations which can be heated in resistive manner as electric heating arrangement.

Another realization of the heating arrangement within the scope of the invention provides that the electric heating arrangement is configured by metallic or ceramic heating elements, which can be pressed on to the inner pane in resilient manner. These are preferably disposed in the peripheral region so as to achieve a sufficiently large viewing area.

The invention is further described in greater detail on the basis of embodiments illustrated in the drawing figures.

The above-discussed embodiments of the present invention will be described further hereinbelow. When the word "invention" is used in this specification, the word "invention" includes "inventions", that is the plural of "invention". By stating "invention", the Applicants do not in any way admit that the present application does not include more than one patentably and non-obviously distinct invention, and maintains that this application may include more than one patentably and non-obviously distinct invention. The Applicants hereby assert that the disclosure of this application may include more than one invention, and, in the event that there is more than one invention, that these inventions may be patentable and non-obvious one with respect to the other.

BRIEF DESCRIPTION OF THE DRAWINGS

The invention is explained in greater detail below with reference to the embodiments which are illustrated in the accompanying drawings.

DESCRIPTION OF THE PREFERRED EMBODIMENTS

Figure 1:
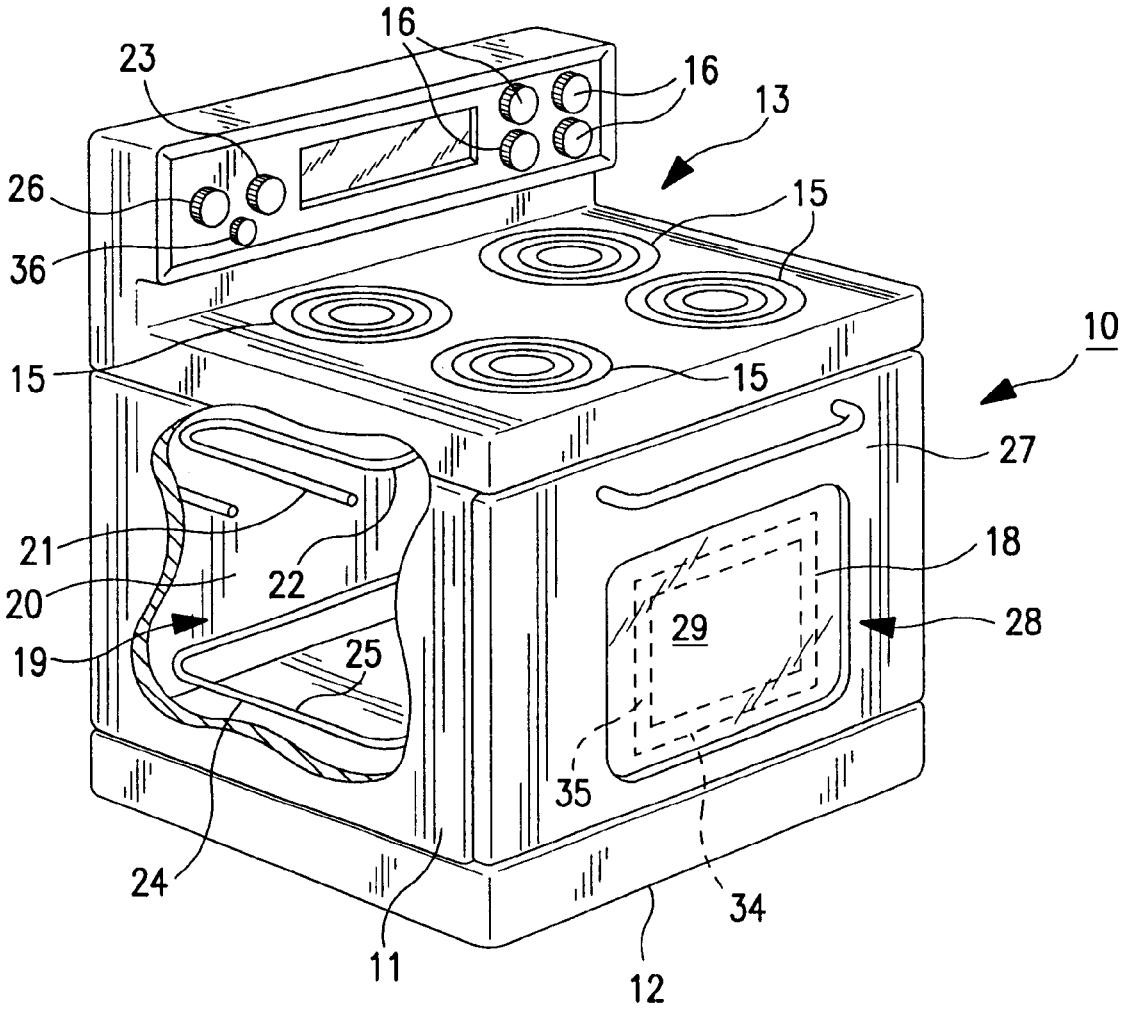
FIG. 1: shows a perspective view of a kitchen stove with oven.

FIG. 1 illustrates a kitchen stove 10 for preparing food, such as, cooking, roasting, boiling, grilling, broiling, and baking food, the stove 10 having a stove body 11. This stove body 11 is configured with a support 12 to support the stove body 11. There is also provided at least one heating arrangement 13 to cook food, with this at least one heating arrangement 13 being disposed atop the stove body 11. The at least one heating arrangement 13 is configured by an arrangement 14 (FIG. 2) to receive a bottom of a cooking utensil 17, at least one first heating element means 15 to cook food, and a first apparatus 16 to select and set a heat setting of the at least one first heating element means 15.

The heating element means 15 is disposed under the receiving arrangement 14 and is configured to pass heat through the receiving arrangement 14 to the bottom of the cooking utensil 17. Other arrangements are within the scope of this invention.

The first heat setting apparatus 16 is configured in such a way so as to select and set a heat setting of the first heating element means 15 at a heat sufficient to cook food.

The stove body 11 is configured with a cooking oven 18, with the cooking oven 18 being configured to cook, roast, boil, grill, broil, and bake food. The cooking oven 18 has an interior 19 confined by walls 20 comprising top and bottom walls, side walls, a rear wall, and a front.

The stove has a second heating arrangement 21 with at least one second heating element means 22 to cook food, and a second apparatus 23 to select and set a heat setting of the second heating element means 22. The second heating element means 22 is disposed in such a way so as to heat the interior 19 of the cooking oven 18 and is configured to cook, roast, boil, grill, broil, and bake food.

The second heat setting apparatus 23 is configured in such a way so as to select and set a heat setting of said second heating element means 22 to a heat sufficient to cook, roast, boil, grill, broil and bake food.

The stove has a third heating arrangement 24 having a third heating element means 25 and a third apparatus 26 to set a heat setting of said third heating element means. This third heating element means 25 is disposed to heat the interior 19 of the cooking oven 18 and is configured to heat the interior 19 of the cooking oven 18 to transform cooking residue, deposited in the interior 19 of the cooking oven 18 upon preparing food in the cooking oven 18, into ash.

The third heat setting apparatus 26 is configured to set a heat setting of the third heating element means 25 at a sufficient heat for a time sufficient to transform cooking residue, deposited in the interior 19 of the cooking oven 18 upon preparing food in the cooking oven 18, into ash.

The front of the cooking oven 18 has an oven door 27 configured to permit access to the interior 19 of the cooking oven 18. The oven door 27 has a window arrangement 28 configured with a viewing area 29 to view food being prepared in the cooking oven 18. This window arrangement 28 includes a first door window pane 30, which may be a transparent window pane, a second door window pane 31, which may be a transparent pane, disposed at a distance from the first door window pane 30, and an arrangement 32 to maintain the first door window pane 30 disposed at a distance from the second door window pane 31. The first door window pane 30 will be an inner door window pane upon closing of the oven door 27.

The first door window pane 30 has a first, inner, surface 33 disposed towards the interior 19 of the cooking oven 18 upon closing of the oven door 27. The second door window pane 31 becoming an outer pane upon closing of the oven door 27.

There is further provided a fourth heating arrangement 34 having a fourth heating element means 35, which may be a metallic heating element, and a fourth apparatus 36 to set a heat setting of the fourth heating element means 35. The fourth heating element means 35 is disposed on or in the first door window pane 30 and is configured to assist in heating by the third heating element means 25 of the first window pane 30. The fourth heating element means 35 is also disposed and configured to assist the third heating element means 25 to transform cooking residue, deposited on the first, inner, surface 33 of the first door window pane 30 upon preparing food in the cooking oven 18, into ash.

The fourth heat setting apparatus 36 is configured to set a heat setting of the fourth heating element means 35 at a sufficient heat for a time sufficient to transform cooking residue, deposited on the first, inner, surface 33 of the first door window pane 30 upon preparing food in the cooking oven 18, into ash, thus at least to assist the third heating element means 25 to transform cooking residue on the first door window pane, into ash.

The first door window pane 30 has a second surface 37 opposite the first surface 33 of the first door window pane 30.

The fourth heating element means 35 may be a layer 2; the layer 2 being configured of a material having portions through which the interior 19 of the cooking oven 18 can be viewed or being transparent.

Preferably, the layer 2 is disposed on the second surface 37 of the first door window pane 30.

The kitchen stove 10 can comprising one of A. and B.: A. the second surface 37 of the first door window pane 30 is configured with a central region 39 and a peripheral region 39*a;* and the layer 2 (FIG. 14) is disposed substantially solely adjacent to the peripheral region 39*a* of the second surface 37 of the first door window pane 30; and B. the layer 5 (FIG. 15) is disposed substantially fully over the entire second surface 37 of the first door window pane 30.

The layers 2 or 5 can be configured of a transparent material.

Figure 2:
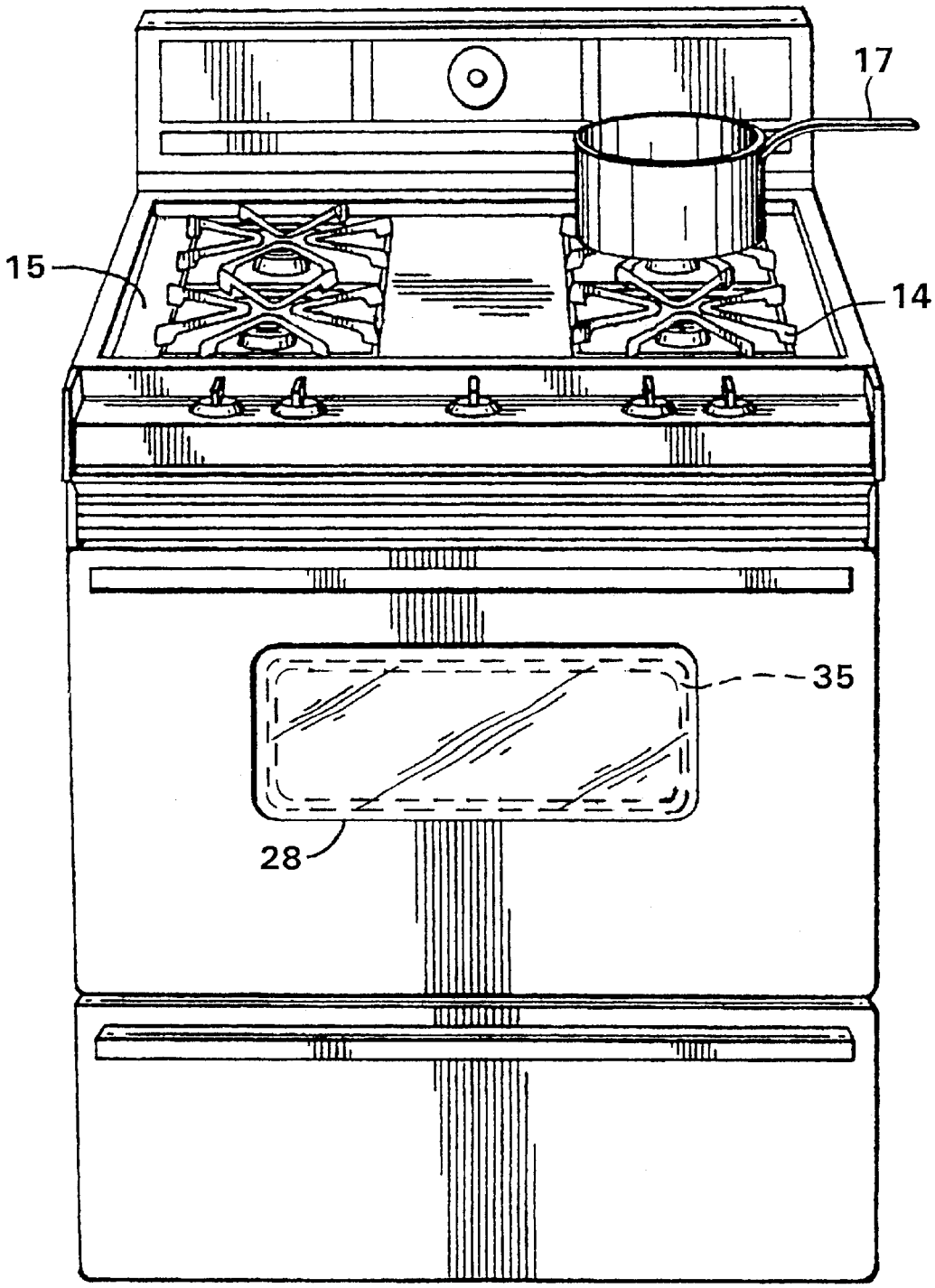
FIG. 2: illustrates a perspective front view of a gas stove with oven.

FIG. 2 illustrates in greater detail an arrangement 14 to receive a bottom of a cooking utensil 17 and at least one first heating element means 15 to cook food. In this embodiment there is provided a metallic heating element 35 in the window arrangement 28, with the metallic heating element 34 serving to heat the window arrangement 28.

FIG. 2 is a copy of FIG. 1 from U.S. Pat. No. 5,405,263 having the title,"Sealed gas burner assembly," having the inventors Gerdes et al., issued on Apr. 11, 1995, from which figure copy all of the reference numerals present in the original figure, as it appears in U.S. Pat. No. 5,405,263, have been removed. U.S. Pat. No. 5,405,263 is hereby incorporated by reference as if set forth in its entirety. The reference numerals that have been removed from FIG. 1 for this U.S. Pat. No. 5,405,263, essentially reproduced herein as FIG. 2, indicate arrangements that are well known in the prior art.

Figure 3:
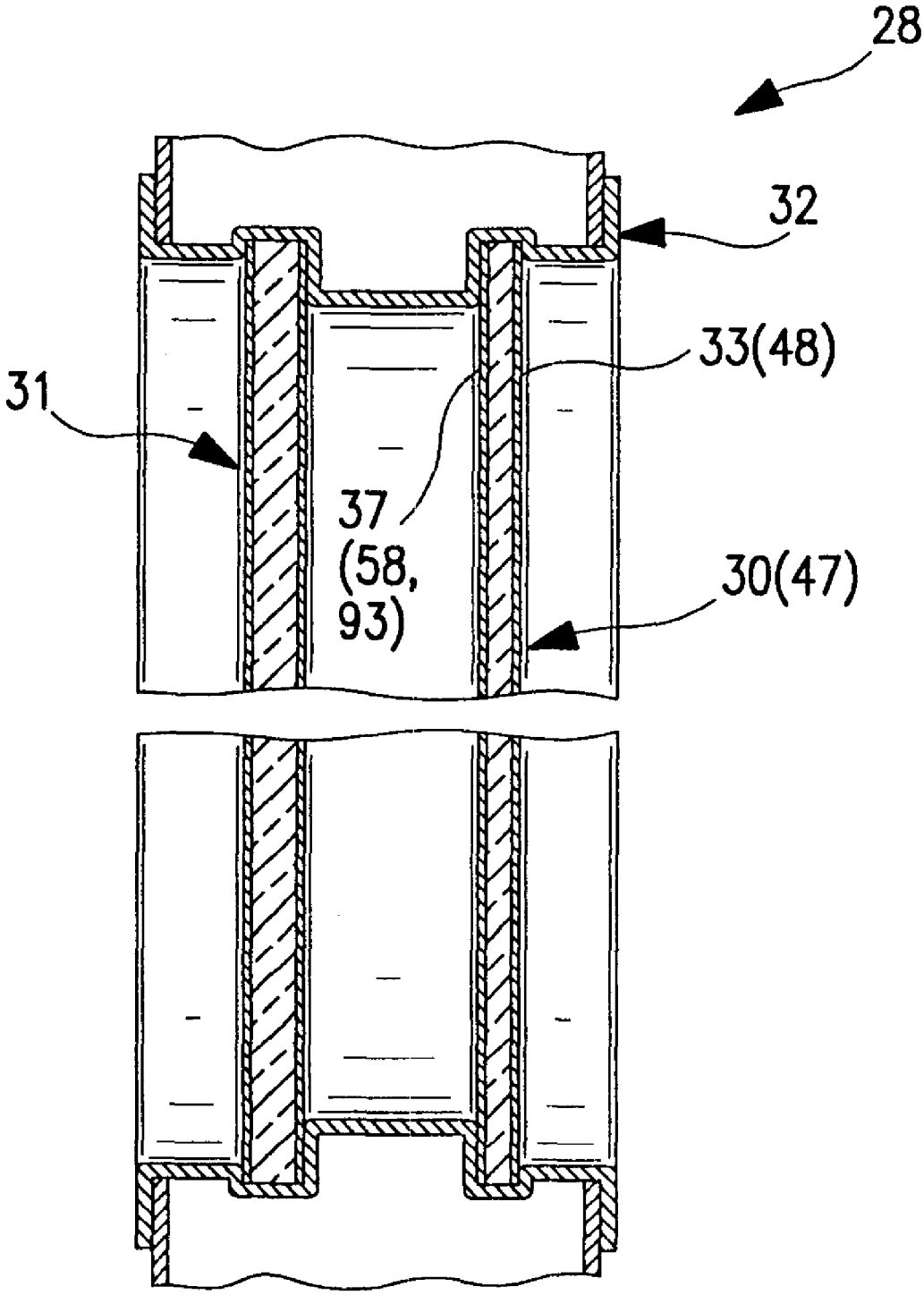
FIG. 3: illustrates a portion of a door window arrangement.

FIG. 3 illustrates details of a window arrangement such as 28, having a first door window pane such as 30 or 47, made of transparent material, the panes 30 and 47 being secured in a frame structure such as 32 and having first surfaces 33 and 48 as well as second, opposite, surface 37 or 58 or 93. A second transparent door window pane 31 is also included in the assembly.

Figure 4:
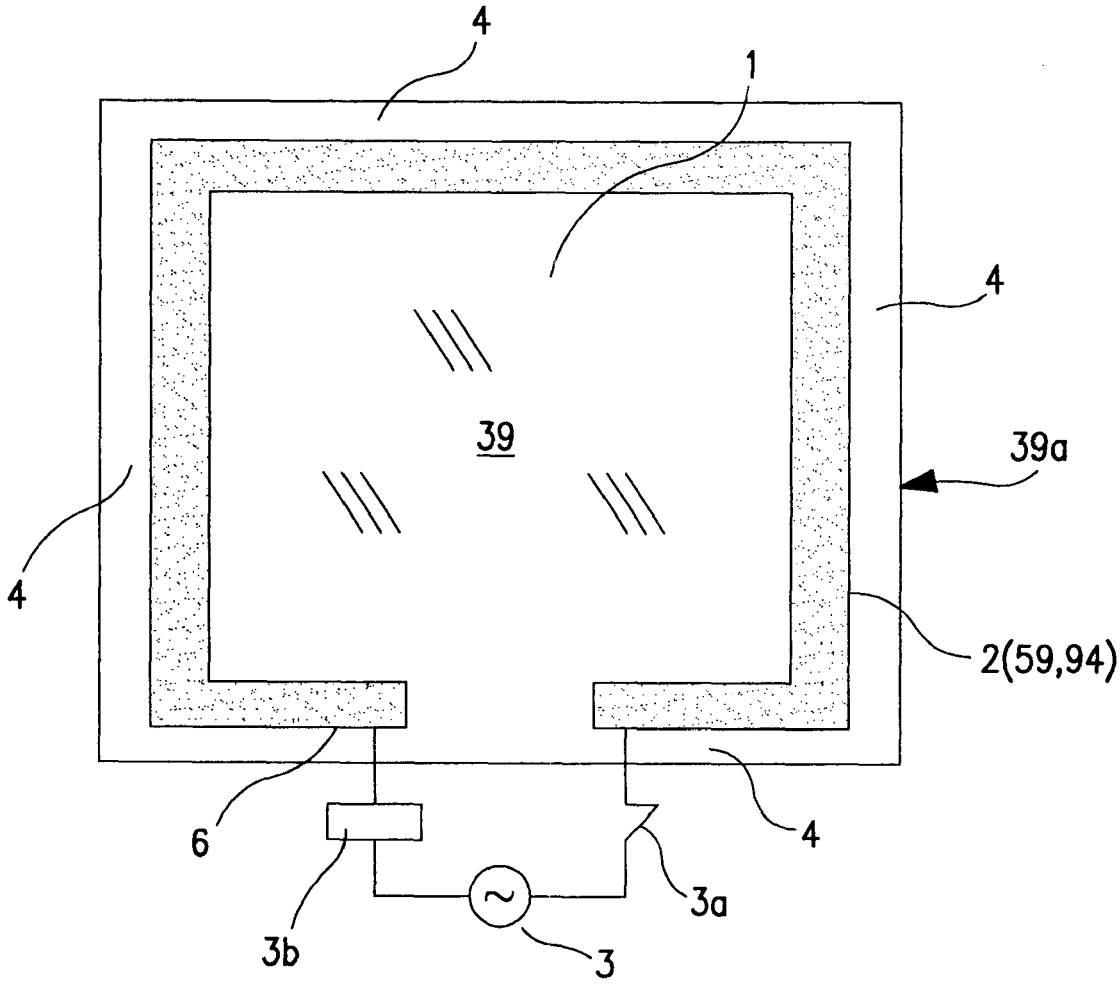
FIG. 4: illustrates a schematic of a door window arrangement.

FIG. 4 illustrates details of a transparent inner pane 1 of a viewing window for baking ovens, made of a temperature-resistant glass or a glass ceramic. The configuration of such viewing windows composed of several panes arranged at a distance from one another is known and, accordingly, need not be discussed in greater detail herein, particularly since for the purpose of one aspect of the invention the focus is on the inner pane, that is, the pane facing the muffle of the baking oven. So as to simplify the cleaning of the inner pane, which may be made difficult, due to the reasons described in the foregoing, also in pyrolytic baking ovens, the inner pane is actively heated by way of an additional heating arrangement to a temperature in the vicinity of 500 degrees Celsius. Since upon a pyrolytic cleaning of the closed baking oven muffle, particularly in the peripheral region of the inner pane, there may remain dirt residues, in the embodiment according to FIG. 4, the peripheral region of the inner pane 1 is configured with a transparent, electrically conductive layer 2 (59, 94) which layer is heated in resistive manner by means of a source of current 3 (main) which is part of a baking oven. Switches, such as, 3*a* and timers, such as, 3*b* are part of the assembly. The pane has a central portion or region 39 and a peripheral portion or region 39*a*. Transparent and electrically conductive layers are know from the state of the art. Such a layer, for example, is a layer made of zinc oxide doped with fluorine. The layer 2 is preferably arranged on that side of the inner pane that is facing away from the muffle, so as not to be subjected to various vapors of the baking oven. As a matter of principle, the layer may also be provided on the surface facing the muffle. Configuration of the layer 2 is accomplished by known methods, for example, by screen printing.

So as to avoid electric arcing from the layer 2 to the metallic, grounded, viewing window frame (not shown in this illustration), the region 4 is maintained free of the conductive layer, using suitable measures. The thickness of the layer is a function of the material used in the layer and is suitably selected so as to attain the required electrical resistance for the required temperature. In place of the illustrated resistively heated layer 2, the heating can be transferred directly by way of heating elements which are resilient and which can be installed by a suitable application pressure, in other words, can be pressed onto the pane, for example, metallic heating elements. Furthermore, heating elements made of ceramic material, for example, silicon nitride ($Si_3N_4$), or silicon carbide (SiC), can be employed. The contacting initially is done by conductor strips 6, applied by screen printing, on the narrow sides of the inner pane 1, which conductor strips are supplied with electric current from the source of power 3. The contacting of the conductor strips 6 can be by way of resiliently, or flexible, pressed-on contacts, or by way of cables that are affixed by solder.

Figure 5:
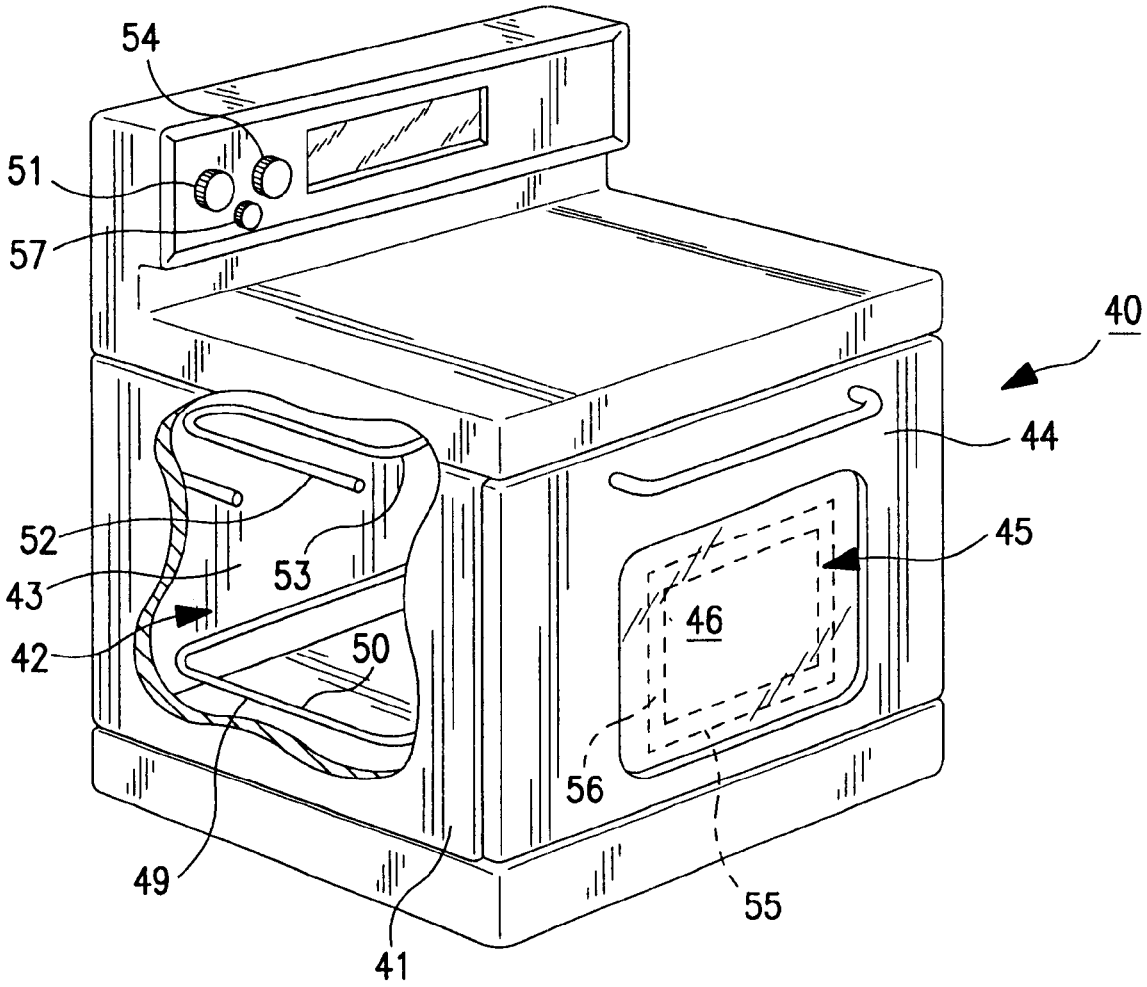
FIG. 5: is an illustration of a stove.

FIG. 5 illustrates an oven 40 for preparing food, the oven 40 having an oven body 41 configured with an interior 42 confined by walls 43 comprising top and bottom walls, side walls, a rear wall, and a front. The front has an oven door 44 configured to permit access to the interior 42 of the oven 40.

The oven door 44 has a window arrangement 45 configured with a viewing area 46 to view food being prepared in the oven 40. This window arrangement 45 has at least one door window pane 47 to be the first door window pane 47 which becomes an inner door window pane 47 upon closing of the oven door 44.

The first door window pane 47 has a first, inner, surface 48 disposed towards the interior 42 of the oven 40 upon closing of the oven door 44.

The oven has a first heating arrangement 49 with at least one first heating element means 50 to prepare food and a first apparatus 51 to select and set a heat setting of the first heating element means 50. The heating element means 50 is configured to prepare food by being disposed to heat the interior 42 of the oven 40. The heat setting apparatus 51 is configured to select and set a heat setting of the first heating element means 50 to a temperature sufficient to prepare food in oven 40.

The oven 40 has a second heating arrangement 52 with a second heating element means 53 and a second apparatus 54 to set a heat setting of the second heating element means 53.

The second heating element means 53 is disposed to heat the interior 42 of the oven 40 and is configured to heat the interior 42 of the oven 40 to transform cooking residue, deposited in the interior 42 of the oven 40 upon preparing food in the oven 40, into ash.

The second heat setting apparatus 54 is configured to set a heat setting of the second heating element means 53 at a sufficient heat for a time sufficient to transform cooking residue, deposited in the interior 42 of the oven 40 upon preparing food in the oven 40, into ash.

There is further provided a third heating arrangement 55 having a third heating element means 56 and a third apparatus 57 to set a heat setting of the third heating element means 56. The third heating element means 56 is disposed on, in, or substantially adjacent to the first door window pane 47 (compare FIGS. 10, 11, and 12) and is configured to assist in heating by the second heating element means 53 of the first door window pane 47. The third heating element means 56, furthermore, is disposed and configured to assist the second heating element means 53 to transform cooking residue, deposited on the first, inner, surface 48 of the first door window pane 47 upon preparing food in the oven 40, into ash. The third heat setting apparatus 57 is configured to set a heat setting of the third heating element means 56 at a sufficient heat for a time sufficient to transform cooking residue, deposited on the first, inner, surface 48 of the first door window pane 47 upon preparing food in the oven 40, into ash, thus at least to assist the second heating element means 53 to transform cooking residue ash on the first door window pane 47, into ash.

The first door window pane 47 (FIG. 3) comprises a second surface 58 opposite the first, inner, surface 48 of the first door window pane 47. The third heating element 56 comprises a layer 59 (FIG. 4), the layer 59 being configured of a material having portions through which the interior of the oven can be viewed, or being a transparent layer, the layer 59 being disposed on the second surface 58 of the first door window pane 47.

The oven 40 may comprising one of A. and B.: A. the second surface 58 of the first door window pane 47 comprises a central region 39 and a peripheral region 39*a*; and the layer 59 is disposed substantially solely adjacent to the peripheral region 39*a* of the second surface 58 of the first door window pane 47; and B. the layer 5, 59 is disposed substantially fully over the entire second surface 58 of the first door window pane 47.

For the oven 40 the layer 2 (5, 59) can comprises a transparent material.

The oven 40 can have at least one of A. to F.: A. the first door window pane 47 has a second surface 93 opposite the first, inner, surface 48 of the first door window pane 47; and the third heating element means 56 which has a layer 94; the layer 94 being configured of a material having portions through which the interior 42 of the oven 40 can be viewed, or the layer 94 being a transparent layer, with the layer 94 being disposed on the second surface 93 of the first door window pane 47, the layer 94 may possibly be a conductive, resistive enamel layer; B. the second surface 93 of the first door window pane 47 has a central region 39 and a peripheral region 39*a*, and the layer 94 is disposed substantially solely adjacent to the peripheral region 39*a* of the second surface 93 of the first door window pane 47; C. the layer 5 (94) is disposed substantially fully (FIG. 15) over the entire second surface 93 of the first door window pane 47; D. the layer 94 comprises a transparent material (FIG. 4); E. one of: i. to vii.: the first door window pane 47 comprises one of: a. and b.: a. a transparent pane (FIG. 9); and b. a pane comprising one of 1. and 2.: 1. temperature-resistant glass; and 2. temperature-resistant glass ceramic; ii. the layer 94 establishing an electric heating arrangement (FIG. 11); iii. the layer 94 being a resistive layer configured to be heated by a source of power 3; iv. strip conductors 6 configured to connect the layer 94 to a source of power 3; the strip conductors 6 being disposed at the peripheral region 39*a* of the second surface 93 of the first door window pane 47; the strip conductors 6 being one of a., b., and c.: a. contact strips 95 (FIG. 13) to connect the layer 94 to a source of power 3; b. contacts, schematically shown by reference numeral 95, to connect the layer 94 to a source of power 3; the contacts, schematically shown by reference numeral 95, comprising resilient contacts pressed onto the first door window pane 47; c. cables to connect the layer 94 to a source of power 3 with the cables comprising cables soldered onto the first door window pane 47; v. the layer 94 being disposed away from the peripheral region 39*a* of the second surface 93 to provide a space 4 through which the interior 42 of the oven 40 can be viewed; vi. the layer 94 being configures as a patterned layer (FIG. 13) to provide a decoration on the first door window pane 47; and vii. the layer 94 being configured as a conductive, resistive enamel layer configured to be heated as electric heating arrangement; F. the third heating element means 56 can be configured as one of a. and b.: a. a resilient metallic heating element 35 (FIG. 2) configured to be pressed-on to the first door window pane 47; and b. a ceramic heating element 55*a* (FIG. 6) configured to be pressed on to the first door window pane 47.

Figure 6:
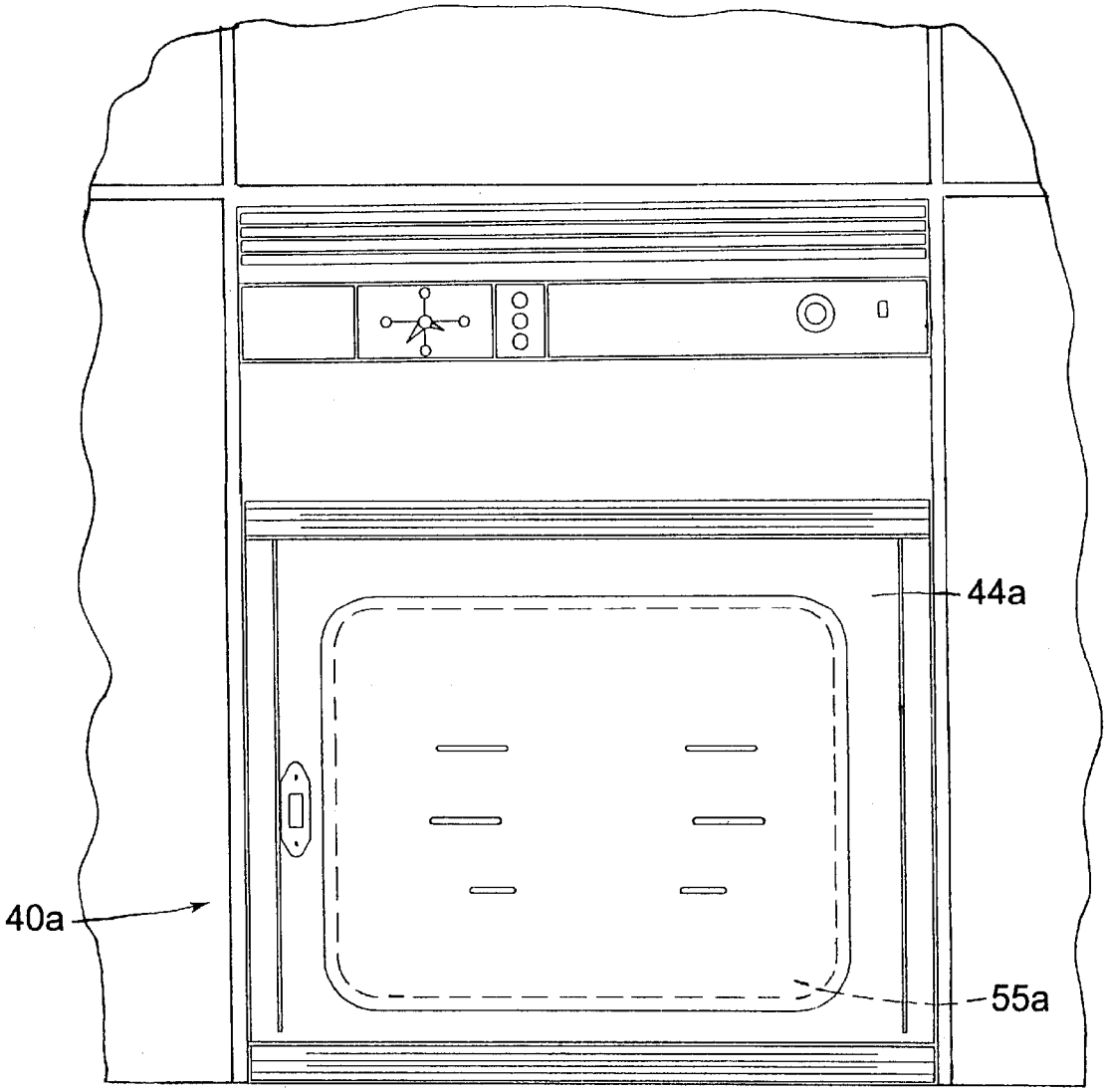
FIG. 6: is an illustration of a built-in stove.

FIG. 6 is an illustration of a built-in stove 40*a* having a door 44*a* and a heating arrangement 55*a*.

Figure 7:
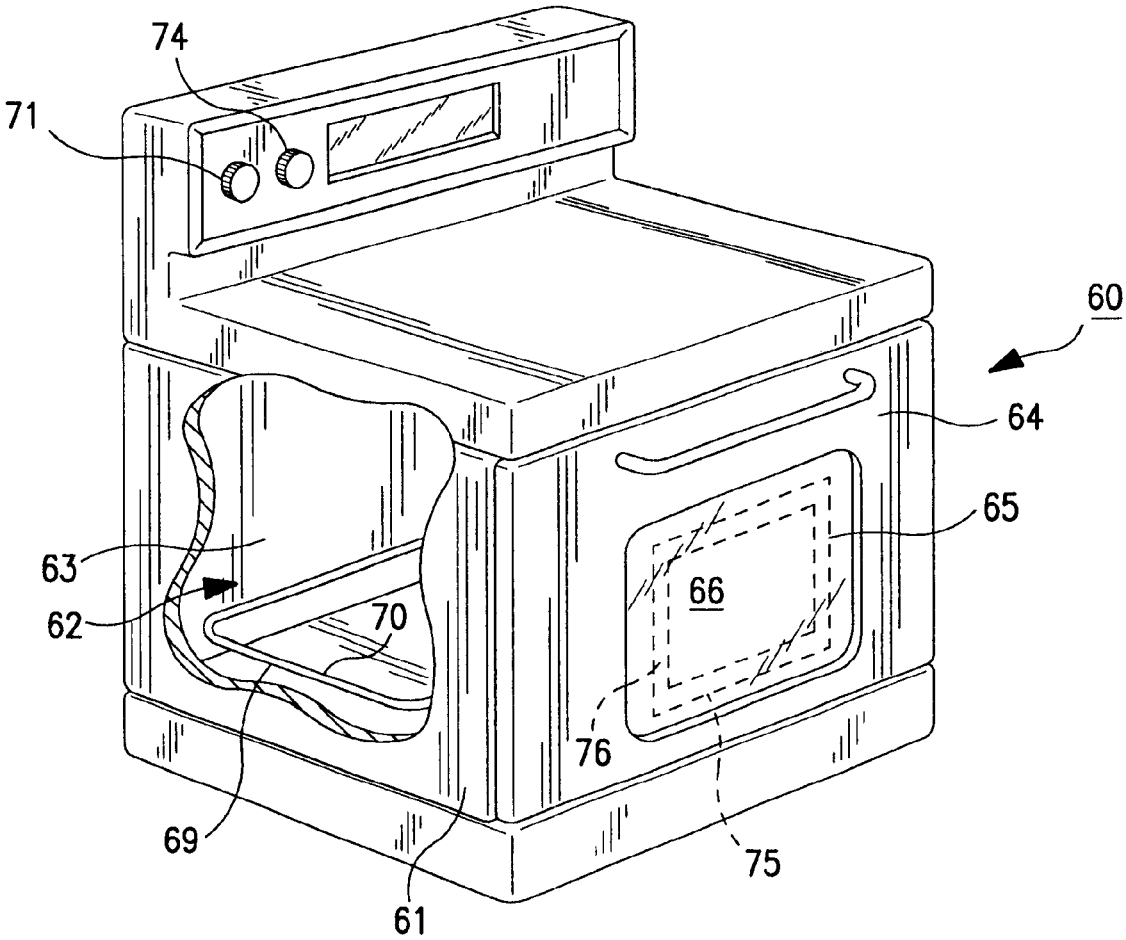
FIG. 7: illustrates a further embodiment of a stove.

FIG. 7 illustrates an oven 60 for the method of cleaning oven 60 for preparing food, the oven 60 having an oven body 61. The oven body 61 is configured with an interior 62 confined by walls 63 comprising top and bottom walls, side walls, a rear wall, and a front. The front has an oven door 64 configured to permit access to the interior 62 of the oven 60, and the oven door 64 having a window arrangement 65 configured with a viewing area 66 to view food is prepared in the oven 60. The window arrangement 65 has at least one door window pane 67 (FIG. 9) of transparent material, with the at least one door window pane 67 being a first door window pane 67 upon assembly, and the first door window pane 67 becoming an inner door window pane 67 upon closing of the oven door 64. The first door window pane 67 has a first, inner, surface 68 disposed towards the interior 62 of the oven 60 upon closing of the oven door 64. The oven 60 has at least one first heating arrangement 69 with at least one first heating element means 70 and a first apparatus 71 to select and set at least two heat settings of the at least one first heating element means 70. The first heating element means 70 is disposed to heat the interior 62 of the oven 60, and the first heating element means 70 is configured to prepare food, and is configured to heat the interior 62 of the oven 60 to transform cooking residue, deposited in the interior 62 of the oven 60 upon preparing food in the oven 60, into ash.

The first heat setting apparatus means 71 is configured to select and set a heat setting of the first heating element means 70 to a temperature sufficient to prepare food, and further is configured to set a heat setting of the first heating element means 70 at a sufficient temperature for a time sufficient to transform cooking residue, deposited in the interior 62 of the oven 60 upon preparing food in the oven 60, into ash.

Oven 60 has a second heating arrangement 75 with a second heating element means 76 and a second apparatus means 74 to set a heat setting of the second heating element means 76. This second heating element means 73 is disposed on, in, or sufficiently adjacent to (FIGS. 10, 11, and 12) the inner door window pane 67 and is configured to assist in heating by the first heating element means 70 to transform cooking residue, deposited on the first, inner, surface 68 of the first door window pane 67. The second heating element means 76 is configured to assist the first heating element means 70 in the heating of the first door window pane 67 to transform cooking residue, deposited on the first, inner, surface 68 of the first door window pane 67 upon preparing food in the oven 60, into ash. The second heat setting apparatus means 74 is configured to set a heat setting of the first heating element means 70 at a sufficient temperature for a time sufficient to transform cooking residue, deposited on the first, inner, surface 68 of the first door window pane 67 upon preparing food in the oven 60, into ash, to thus assist the first heating element means 70 in the heating of the first door window pane 67 to transform cooking residue into ash on the first door window pane 67, with the method comprising the steps of: disposing food in the interior 62 of the oven 60; preparing food in the oven 60; removing prepared food from the oven 60; depositing a first, cooking, residue on the walls 63 of the oven 60 and on the first, inner, surface 68 of the first door window pane 67; setting the first heat setting apparatus means 71 to a temperature sufficient to transform the first, cooking, residue, deposited in the interior 62 of the oven 60 upon the cooking of food, into a second, converted, residue more readily removable from the interior 62 of the oven 60 than the first, cooking, residue; setting the second heat setting apparatus means 74 to a temperature sufficient to assist the first heating element means 70 to transform the first, cooking, residue, deposited on the first, inner, surface 68 of the first door window pane 67 upon the cooking of food, into a second, converted, residue more readily removable from the first, inner, surface 68 of the first door window pane 67 than the first, cooking, residue; and removing the second, converted, residue from the first, inner, surface 68 of the first door window pane 67.

Figure 8:
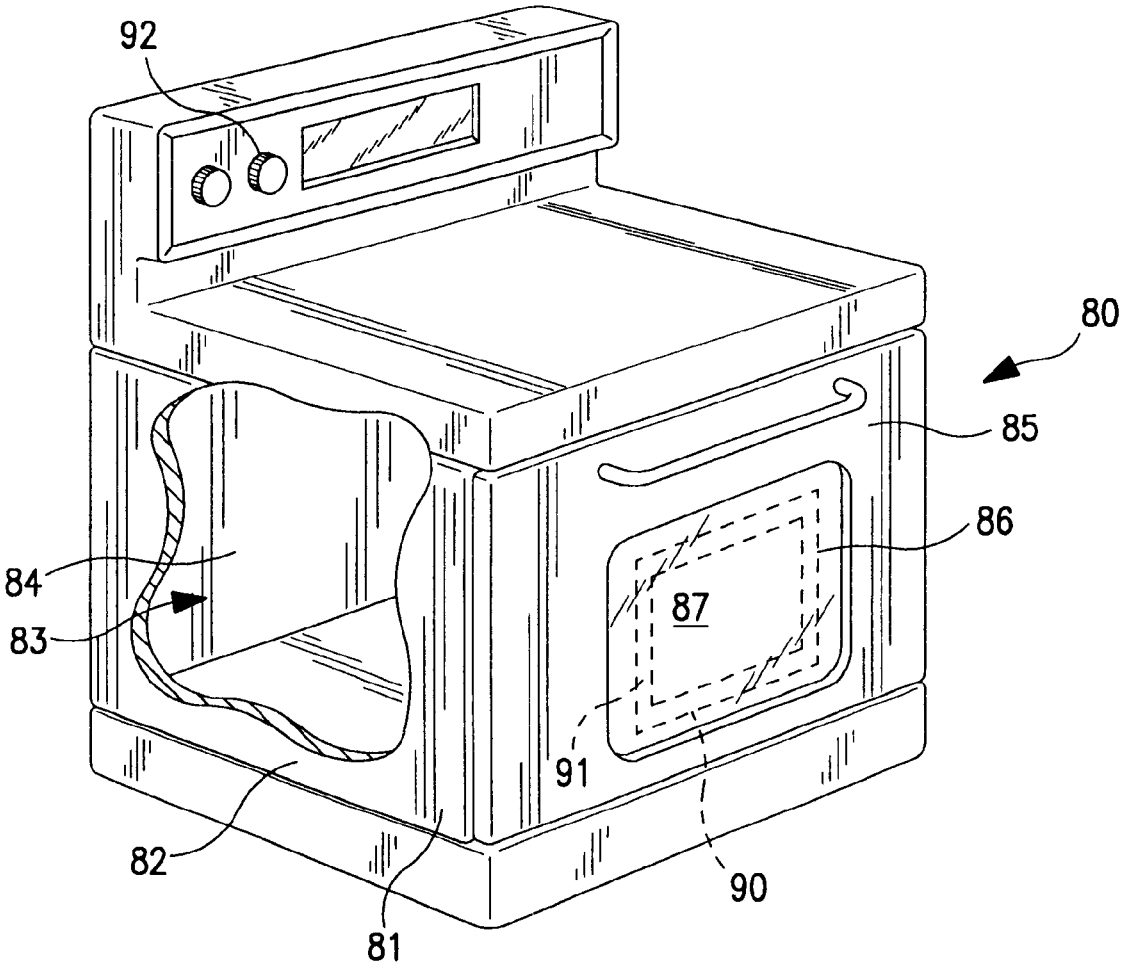
FIG. 8: is an illustration of another embodiment of a stove.

A further method is described with reference to FIG. 8 illustrating an oven 80 for preparing food, the oven 80 having an oven structure 81 configured to prepare food, with the oven structure 81 having an oven body 82 is configured with an interior 83 confined by walls 84 being top and bottom walls, side walls, a rear wall, and a front. The front has an oven door 85 configured to permit access to the interior 83 of the oven 80. The oven door 85 includes a window arrangement 86 configured with a viewing area 87 to view food is prepared in the oven 80. This window arrangement 86 has at least one door window pane 88 (FIG. 9) which may be a first and transparent door window pane 88 having a first, inner, surface 89 disposed towards and in the interior 83 of the oven 80 upon closing of the oven door 85.

There is also provided a heating arrangement 90 with a heating element means 91 and an apparatus means 92 to set a heat setting of the heating element means 91. This heating element means 91 is disposed on, in, or sufficiently adjacent to the first door window pane 88 to heat the first door window pane 88. The heating element means 91 is configured to heat the first door window pane 88 to transform a first, cooking, residue, deposited on the first, inner, surface 89 of the first door window pane 88 upon preparing food in the oven 80, into a second, converted, residue. The heat setting apparatus means 92 is configured to set a heat setting of the heating element means 91 at a sufficient heat for a time sufficient to transform the first, cooking, residue, deposited on the first, inner, surface 89 of the first door window pane 88 upon preparing food in the oven 80, into the second, converted, residue; with the method comprising the steps of: disposing food in the interior 83 of the oven 80; preparing food in the oven 80; depositing a first, cooking, residue from cooked food on the first, inner, surface 89 of the first door window pane 88; removing prepared food from the oven 80; setting the heat setting apparatus means 92 to a heat sufficient to transform the first, cooking, residue, deposited on the first, inner, surface 89 of the first door window pane 88 upon preparing food, into a second, converted, cooking residue more readily removable from the interior 83 of the oven 80 than the first, cooking, residue; setting the heat setting apparatus means 92 to a heat sufficient to transform the first, cooking, residue, deposited on the first, inner, surface 89 of the first door window pane 88 upon preparing food, into a second, converted, cooking residue more readily removable from the first, inner, surface 89 of the first door window pane 88 than the first, cooking, residue; and removing the second, converted, cooking residue from the first, inner, surface 89 of the first door window pane 88.

The first door window pane 88 has a second surface 93 opposite the first, inner, surface 89 of the first door window pane 88. The heating element means 91 can be configured by a layer 94 configured of a material having portions through which the interior 83 of the oven 80 can be viewed, with the layer 94 being disposed on the second surface 93 of the first door window pane 88.

The second surface 93 of the first door window pane 88 comprises a central region 39 and a peripheral region 39*a*, with the layer 94 being disposed substantially solely adjacent to the peripheral region 39*a* of the second surface 93 of the first door window pane 88.

In one embodiment the layer 5 (94) is disposed substantially fully (FIG. 15) over the entire second surface 93 of the first door window pane 88.

In another embodiment, the layer 94 is configured of a transparent material (FIG. 4).

In a further embodiment, the first door window pane 88 comprises one of: a. and b.: a. a transparent pane (FIG. 9); and b. a pane comprising one of 1. and 2.: 1. temperature-resistant glass; and 2. temperature-resistant glass ceramic.

The layer 94 can be configured as an electric heating arrangement or can be configured as a resistive layer configured to be heated by a source of power 3.

There are also provided strip conductors 6 configured to connect the layer 94 to a source of power 3, the strip conductors 6 being disposed at the peripheral region 39*a* of the second surface 93 of the first door window pane 88. These strip conductors 6 may be configured as one of: a., b., and c.: a. contact strips 95 (FIG. 13) to connect the layer 94 to a source of power 3; b. contacts, schematically shown by reference numeral 95, to connect the layer 94 to a source of power 3; the contacts being configured as resilient contacts pressed onto the first door window pane 88; c. cables to connect the layer 94 to a source of power 3, the cables being cables soldered onto the first door window pane 88.

The layer 94 is disposed away from the peripheral region 39*a* of the second surface 93 to provide a space 4 through which the interior 83 of the oven 80 can be viewed.

Figure 13:
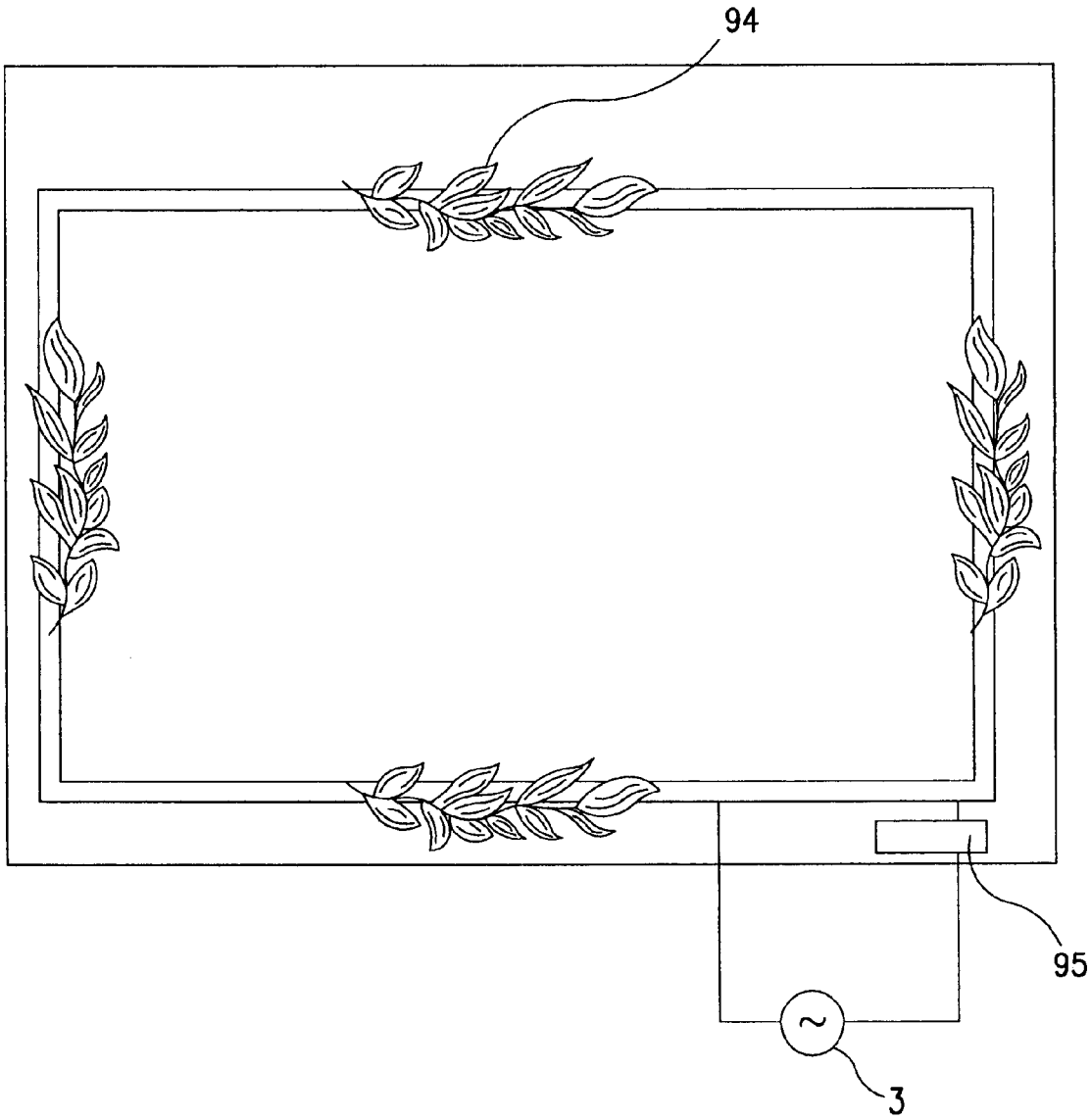
FIG. 13: is a view of a decorative heating arrangement.

As shown in FIG. 13 the layer 94 is patterned to provide a decoration on the first door window pane 88. This layer 94 may be a conductive, resistive enamel layer configured to be heated as electric heating arrangement.

The heating element means 91 can be configured as one of a. and b.: a. a resilient metallic heating element 35 (FIG. 2) configured to be pressed-on to the first door window pane 88; and b. a ceramic heating element 55*a* (FIG. 6) configured to be pressed-on to the first door window pane 88.

Thus, oven 80 can be configured with at least one of A. to F.: A. the first door window pane 88 has a second surface 93 opposite the first, inner, surface 89 of the first door window pane 88; and the heating element means 91 comprises a layer 94; the layer 94 is configured of a material having portions through which the interior 83 of the oven 80 can be viewed; the layer 94 is disposed on the second surface 93 of the first door window pane 88; B. the second surface 93 of the first door window pane 88 has a central region 39 and a peripheral region 39*a*; and the layer 94 is disposed substantially solely adjacent to the peripheral region 39*a* of the second surface 93 of the first door window pane 88; C. the layer 5 (94) is disposed substantially fully (FIG. 15) over the entire second surface 93 of the first door window pane 88; D. the layer 94 comprises a transparent material (FIG. 4); E. one of: i. to vii.: i. the first door window pane 88 is configured as one of: a. and b.: a. a transparent pane (FIG. 9); and b. a pane comprising one of 1. and 2.: 1. temperature-resistant glass; and 2. temperature-resistant glass ceramic; ii. the layer 94 can be configured as an electric heating arrangement (FIG. 11); iii. the layer 94 can be configured as a resistive layer configured to be heated by a source of power 3; iv. strip conductors 6 can be configured to connect the layer 94 to a source of power 3, with the strip conductors 6 being disposed at the peripheral region 39*a* of the second surface 93 of the first door window pane 88; the strip conductors 6 possibly being configured as one of a., b., and c.: a. contact strips 95 (FIG. 13) to connect the layer 94 to a source of power 3; b. contacts to connect the layer 94 to a source of power 3; the contacts being configured as resilient contacts pressed onto the first door window pane 88; c. cables to connect the layer 94 to a source of power 3; the cables being cables soldered onto the first door window pane 88; v. the layer 94 is disposed away from the peripheral region 39*a* of the second surface 93 to provide a space 4 through which the interior 83 of the oven 80 can be viewed; vi. the layer 94 is configured by a patterned layer (FIG. 13) to provide a decoration on the first door window pane 88; and vii. the layer 94 possibly being configured by a conductive, resistive enamel layer configured to be heated as electric heating arrangement; F. the heating element means 91 can be configured as one of a. and b.: a. a resilient metallic heating element 35 (FIG. 2) configured to be pressed-on to the first door window pane 88; and b. a ceramic heating element 55*a* (FIG. 6) configured to be pressed-on to the first door window pane 88.

Figure 9:
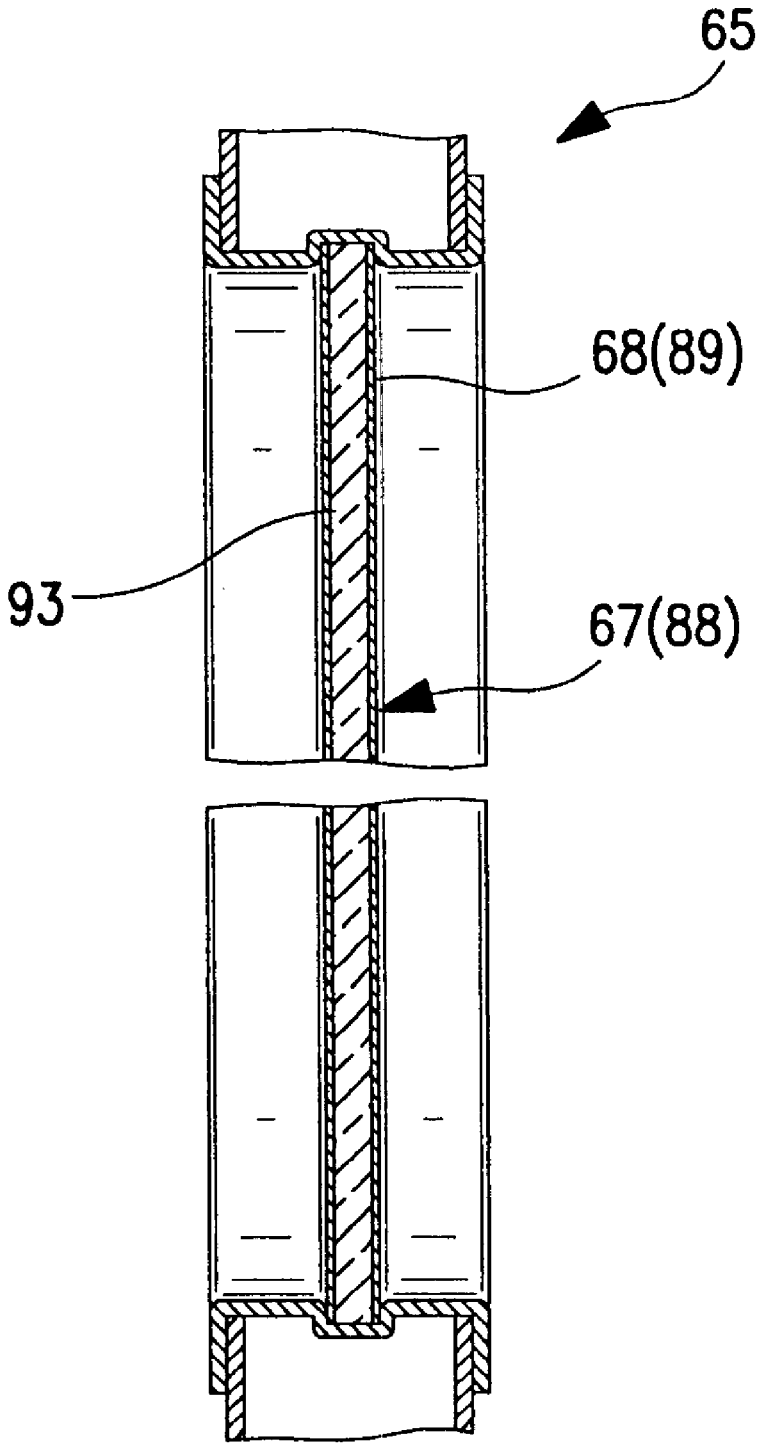
FIG. 9: illustrate details of a door window arrangement.

FIG. 9 illustrates a single transparent pane such as 67. The pane may be a temperature-resistant glass or a temperature-resistant glass ceramic.

Figure 10:
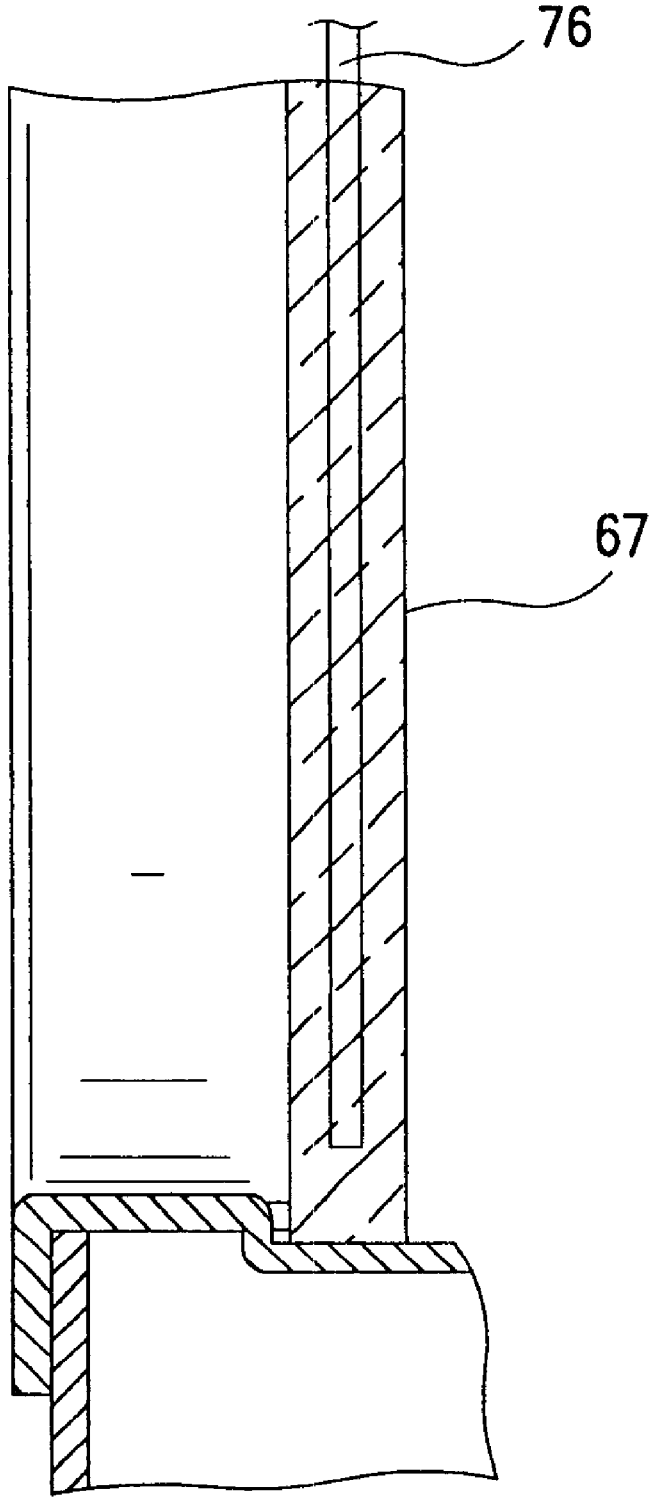
FIG. 10: illustrates one embodiment of a heat apparatus means.

FIG. 10 illustrates a door window pane such as 67, with a heating element means 76 being disposed in the pane 67.

Figure 11:
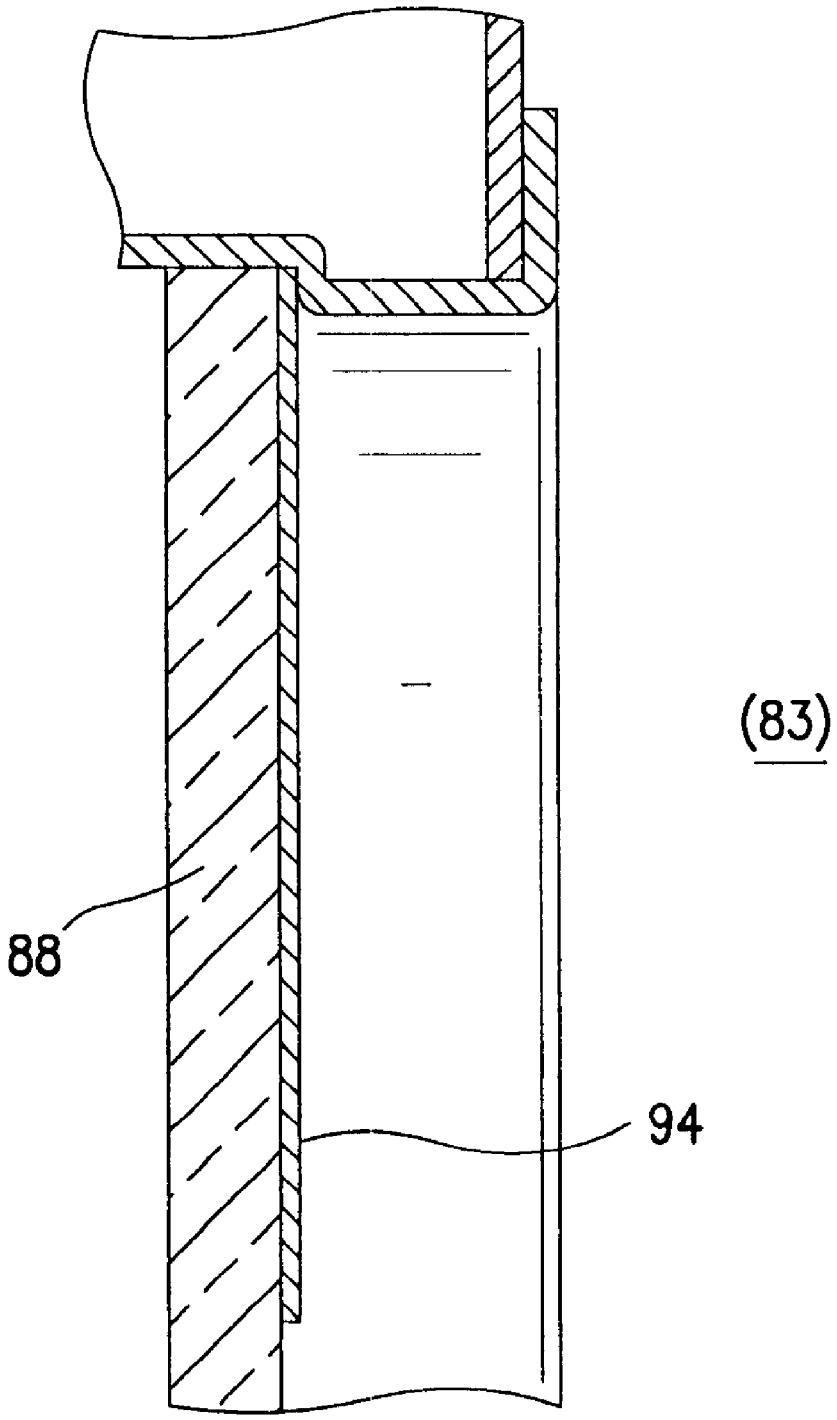
FIG. 11: is a detail of an electric heating arrangement.

FIG. 11 illustrates a door window pane such as 88 with an electric heating arrangement means 94 being disposed on the pane 88—facing the interior of the oven; the layer may also be configured a resistive layer.

Figure 12:
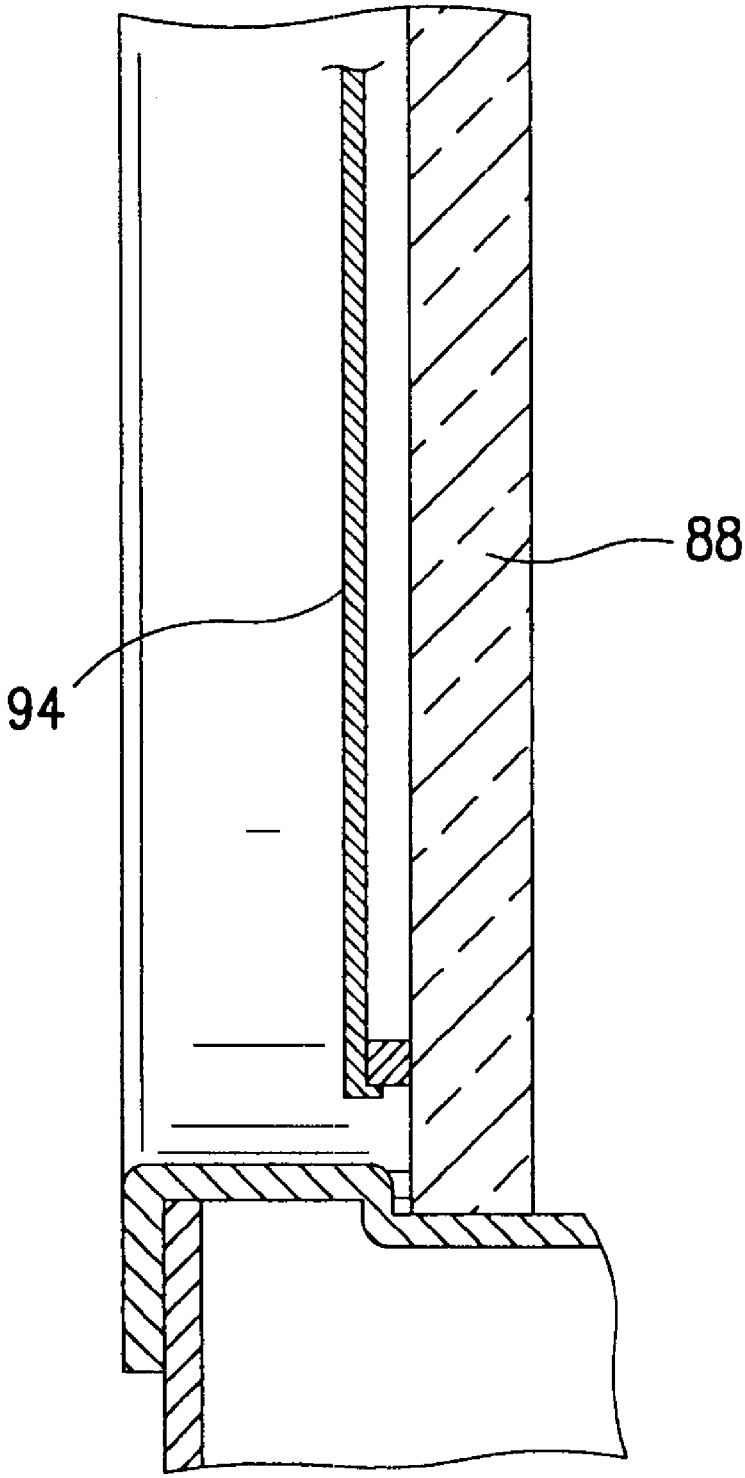
FIG. 12: illustrates a further embodiment of a heating arrangement.

FIG. 12 illustrates a heating element means such as 94 disposed adjacent a pane such as 88.

FIG. 13 illustrates a decorative heating arrangement 94 with contact strips 95, the heating arrangement possibly being configured of a conductive resistive enamel.

FIGS. 1, 5, 7, and 8 are adaptations of FIG. 1 of U.S. Pat. No. 4,775 having the title, "Open-loop self-cleaning oven temperature control," having the inventor Sinn, issued on Oct. 4, 1988, in which Figure the reference numerals present in the original figure, as it appears in U.S. Pat. No. 4,775,777, have been modified or adapted to conform to the present disclosure. U.S. Pat. No. 4,775,777 is hereby incorporated by reference as if set forth in its entirety. The reference numerals that have been removed from FIG. 1 for this U.S. Pat. No. 4,775,777 essentially reproduced herein as FIGS. 1, 5, 7, and 8 indicate arrangements that are well known in the prior art.

Figure 14:
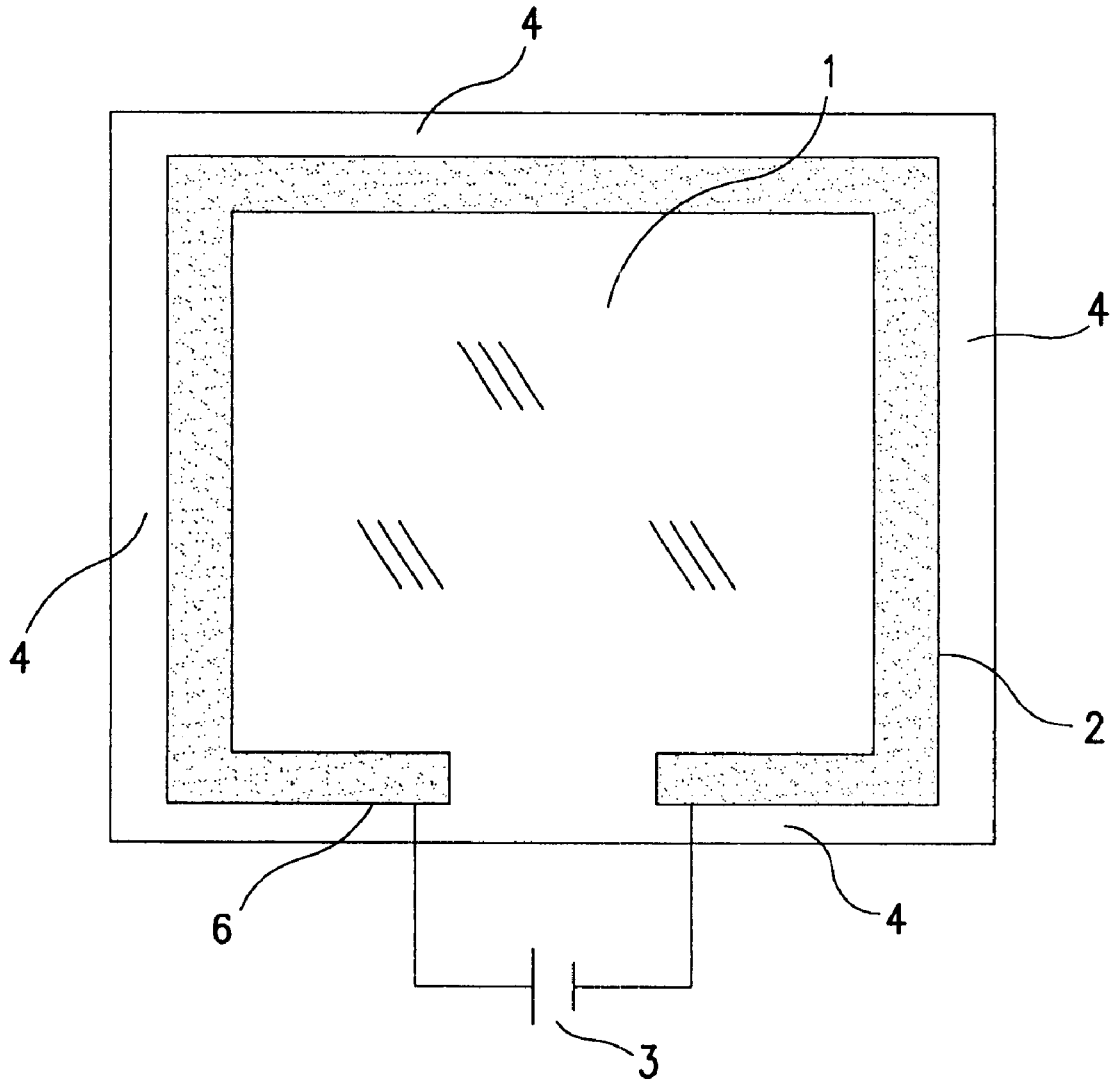
FIG. 14: in a schematic plan view illustration, shows the inner pane of a viewing window for baking ovens, with an electrically conducting, transparent, layer, with the layer extending over the peripheral region of the inner pane, which layer is heated in resistive, electric manner.

FIG. 14 illustrates a transparent inner pane 1 of a viewing window for baking ovens, made of a temperature-resistant glass or a glass ceramic. The configuration of such viewing windows composed of several panes arranged at a distance from one another is known and, accordingly, need not be discussed in greater detail herein, particularly since for the purpose of the invention the focus is on the inner pane, that is, the pane facing the muffle of the baking oven.

So as to simplify the cleaning of the inner pane, which may be made difficult, due to the reasons described in the foregoing, also in pyrolytic baking ovens, the inner pane is actively heated by way of an additional heating arrangement to a temperature in the vicinity of 500 degrees Celsius. Since upon a pyrolytic cleaning of the closed baking oven muffle, particularly in the peripheral region of the inner pane, there may remain dirt residues, in the embodiment according to FIG. 14, the peripheral region of the inner pane 1 is configured with a transparent, electrically conductive layer 2, which layer is heated in resistive manner by means of a source of current 3 (main) which is part of a baking oven.

Transparent and electrically conductive layers are know from the state of the art. Such a layer, for example, is a layer made of zinc oxide doped with fluorine.

The layer 2 is preferably arranged on that side of the inner pane that is facing away from the muffle, so as not to be subjected to various vapors of the baking oven. As a matter of principle, the layer may also be provided on the surface facing the muffle.

Configuration of the layer 2 is accomplished by known methods, for example, by screen printing.

Figure 15:
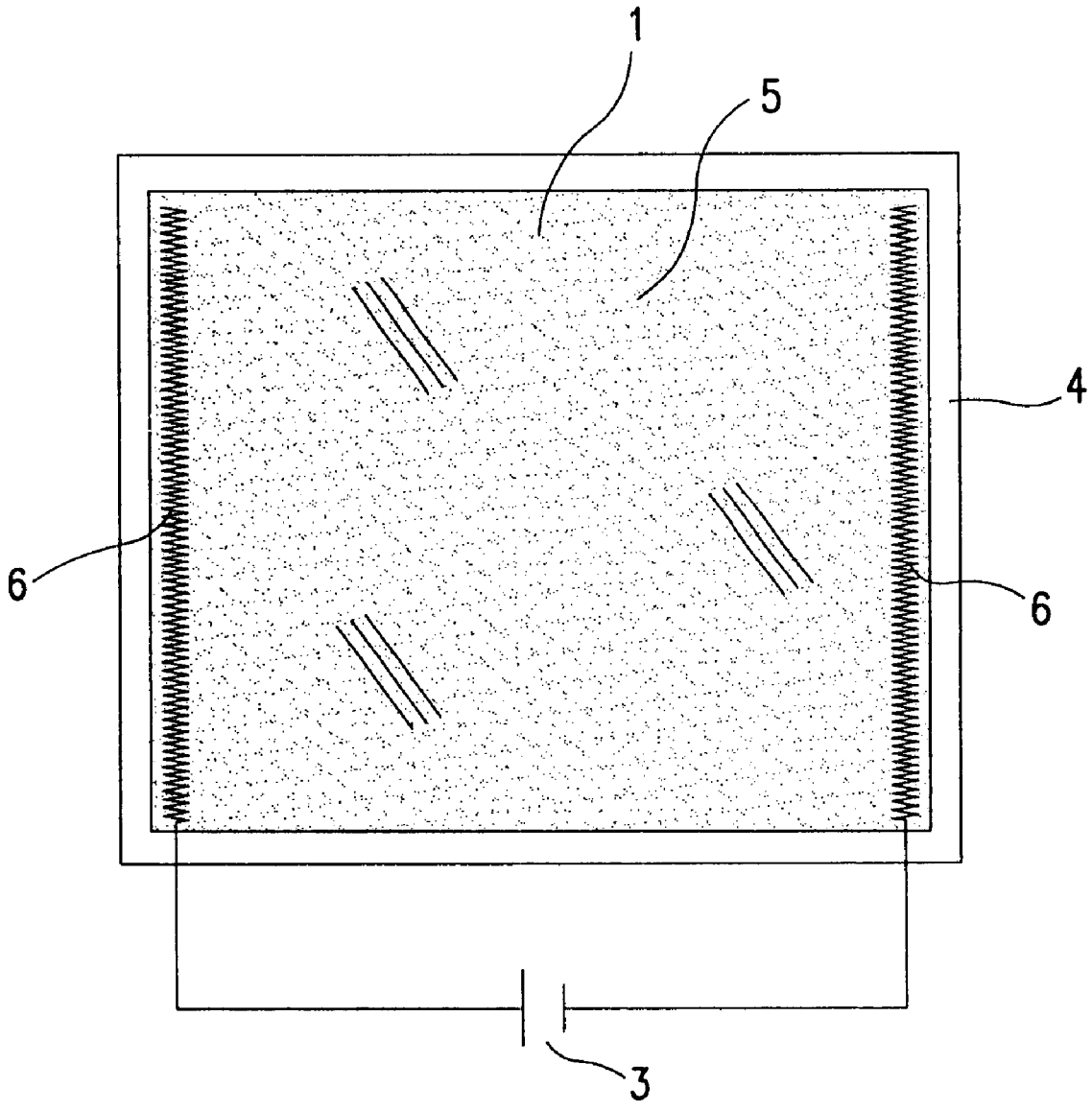
FIG. 15: in a plan view illustration in analogous manner with respect to FIG. 1, shows a corresponding inner pane, in which, however, the transparent, electrically conductive, and resistively heated layer extends over the full area of the pane.
Figure 16A:
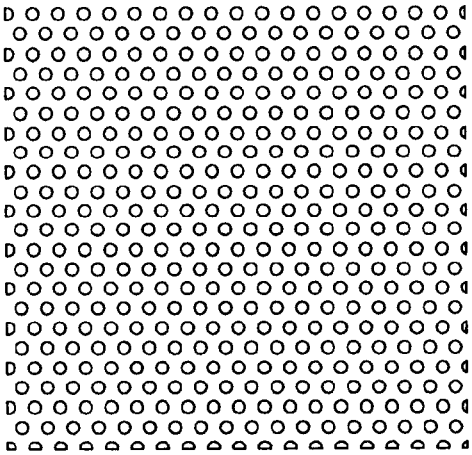
FIG. 16: shows four embodiments of possible patterns for a door window pane.
Figure 16B:
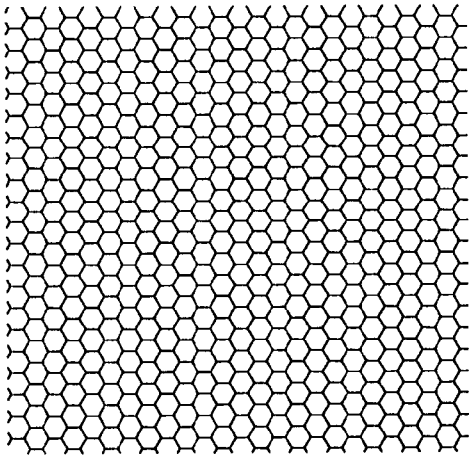
Figure 16C:
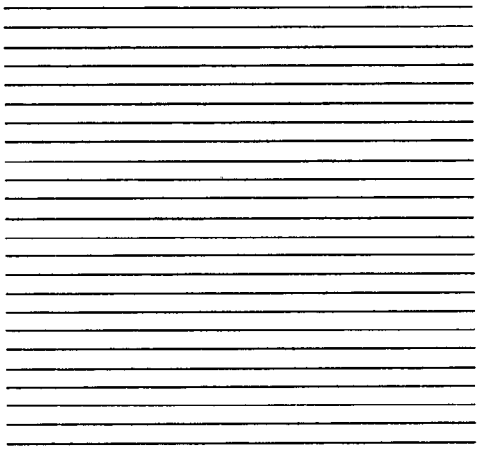
Figure 16D:
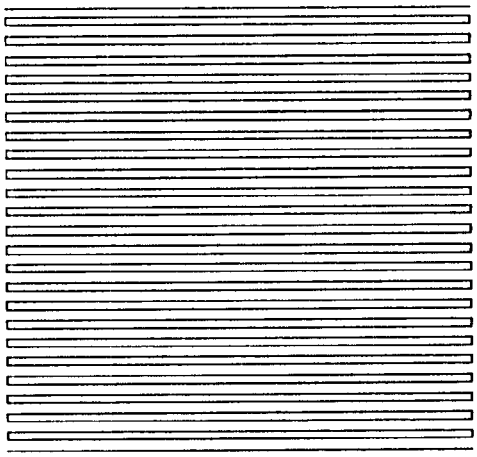

So as to avoid electric arcing from the layer 2 to the metallic, grounded, viewing window frame, not shown in FIGS. 14 and 15, the peripheral region 4 is maintained free of the conductive layer, using suitable measures.

The thickness of the layer is a function of the material used in the layer and is suitably selected so as to attain the required electrical resistance for the required temperature.

In place of the illustrated resistively heated layer 2, the heating can be transferred directly by way of heating elements which are resilient and which can be installed by a suitable application pressure, in other words, can be pressed onto the pane, for example, metallic heating elements. Furthermore, heating elements made of ceramic material, for example, silicon nitride ($Si_3N_4$), or silicon carbide (SiC), can be employed.

The contacting initially is done by conductor strips 6, applied by screen printing, on the narrow sides of the inner pane 1, which conductor strips are supplied with electric current from the source of current 3.

The contacting of the conductor strips 6 can be by way of resiliently, or flexible, pressed on contacts, or by way of cables that are affixed by solder.

The inner pane can additionally be configured with a decorative printing, which decorative printing serves to conceal interior door arrangements.

It is within the scope of the invention that heating is carried out by way of conductive enamel-decorations which may be disposed on the inner pane 1 on the surface directed towards the muffle, or on the surface facing away from the muffle. The configuration may be in meandering decorative arrangement.

The baking oven door is locked during the cleaning process, so as to avoid contact with the inner pane, so that the operating person does not receive an electric shock, in the event that the electrically conducting layer is provided on the surface facing the muffle.

FIGS. 16*a*, 16*b*, 16*c*, and 16*d* illustrate possible patterns for possible door window pane assemblies.

It will be appreciated that glass or glass ceramic of such stove or oven window panes transmit heat faster than the walls defining the oven, due to the walls having suitable insulation. Thus, the temperature of the door window pane is below that of the walls and the heating arrangement for the door window pane ensures cleaning of the door window panes described above.

One feature of the invention resides broadly in a viewing window for baking ovens with self-cleaning pyrolytic arrangement, * configured by at least two transparent panes, an inner pane facing the muffle of the baking oven, the pane being made of temperature-resistant glass or glass ceramic and an outer pane arranged at a distance from the inner pane, characterized thereby that the inner pane (1) is configured with an electric heating arrangement (2; 5) for a pyrolytic self-combustion/spontaneous combustion.

Another feature of the invention resides broadly in a viewing window characterized thereby that the electric heating arrangement is configured by a transparent, electrically conductive layer (2, 5), which can be heated in resistive manner by way of a source of current (3).

Yet another feature of the invention resides broadly in a viewing characterized thereby that the layer (2, 5) is provided on that side of the inner pane (1) which is facing away from the muffle.

Still another feature of the invention resides broadly in a viewing window characterized thereby that the layer (2) is provided solely in the peripheral region of the inner pane (1).

A further feature of the invention resided broadly in a viewing window characterized thereby that the layer (5) is provided fully over the surface of the inner pane (1).

Another feature of the invention resides broadly in a viewing window characterized thereby that for contacting of the layer (5) with the source of current (3) at both narrow sides or longitudinal sides respectively one strip conductor (6) is arranged.

Yet another feature of the invention resides broadly in a viewing window characterized thereby that between the outer periphery of the layer (2) and the edge of the inner pane (1) there is formed a free space (5) that is not coated.

Still another feature of the invention resides broadly in a viewing window characterized thereby that the electric connection of the layer (2, 5) with the source of current (3) is accomplished by way of applied contact strips, or by contacts that are pressed on in a resilient manner, or by way of cables that are secured by soldering.

A further feature of the invention resides broadly in a viewing window characterized thereby that the inner pane is additionally furnished with decorations.

Another feature of the invention resides broadly in a viewing window characterized thereby that the decorations as configured as conductive enamel-decorations which can be heated in resistive manner as electric heating arrangement.

Yet another feature of the invention resides broadly in a viewing window characterized thereby that the electric heating arrangement is configured by metallic or ceramic heating elements, which can be pressed-on to the inner pane in resilient manner.

Viewing windows, as discussed, are typically configured by at least two transparent windows, an inner pane (1), facing the muffle of the baking oven, made of temperature-resistant glass or glass ceramic and at least one outer pane disposed at a distance from the inner pane.

The cleaning of the inner pane (1) is not without difficulties even in the case of baking ovens with pyrolytic self-combustion arrangements, since residues arise which are difficult to remove.

A self-cleaning which removes all residues, in accordance with the invention is made possible when the inner pane (1) is configured with an electric heating arrangement (2) for effecting a pyrolytic self-combustion.

The components disclosed in the various publications, disclosed or incorporated by reference herein, may be used in the embodiments of the present invention, as well as equivalents thereof.

The appended drawings in their entirety, including all dimensions, proportions and/or shapes in at least one embodiment of the invention, are accurate and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The details in the patents, patent applications and publications incorporated herein by reference as if fully set forth herein may be considered to be incorporable, at Applicants' option, into the claims during prosecution as further limitations in the claims to patentably distinguish any amended claims from any applied prior art.

The corresponding foreign patent application, namely, Federal Republic of Germany Patent Application No. 100 57 604.4 which was filed on Nov. 21, 2001, having inventors Oliver GROS and Dr. Peter NAβ, and DE-OS 100 57 604 and DE-PS 100 57 604, as well as their published equivalents, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

U.S. patent application Ser. No. 09/931,586, filed on Aug. 16, 2001, having the inventors Kurt LEUTNER, Oliver GROS, Joachim GRÜTZKE, Bernhard GÖTZ, and Walter GRAMLICH with Attorney Docket No. NHL-GAI-03 US (SCT) having the title,"A stove for cooking food and like appliances with a door having a window and a temperature indicating device thereon," and claiming priority from Federal Republic of Germany Patent Application No. 100 40 321.2 which was filed on Aug. 17, 2000, and DE-OS 100 40 321 and DE-PS 100 40 321, are hereby incorporated by reference as if set forth in their entirety herein.

U.S. patent application Ser. No. 09/898,918, filed on Jul. 3, 2001, having the inventors Kurt LEUTNER and Oliver GROS, with Attorney Docket No. NHL-FMW-07 US (SCT) having the title, "Stove for cooking food with a viewing window for household appliances, such as cooking stoves or ovens," and claiming priority from Federal Republic of Germany Patent Application No. 100 32 733.8-16 which was filed on Jul. 05, 2000, and DE-SO 100 32 733 and DE-PS 100 32 733, are hereby incorporated by reference as if set forth in their entirety herein.

U.S. patent application Ser. No. 09/952,314, filed on Sep. 24, 2001, having inventor Torsten GABELMANN and having Attorney Docket No. NHL-FMW-08 (SCT) US having the title,"A gas stove for cooking food with at least one gas burner and a gas cooktop for cooking food with at least one gas burner," and claiming priority from Federal Republic of Germany Patent Application No. 200 16 145.8, filed on Sep. 18, 2000, and DE-OS 200 16 145 and DE-PS 200 16 145, are hereby incorporated by reference as if set forth in their entirety herein.

U.S. patent application Ser. No. 09/898,892, filed on Jul. 3, 2001, having inventors Dr. Ina MITRA, Dr. Friedrich SIEBERS, Dr. Otmar BECKER, Dr. Andreas SCHMINKE, Dr. Bernd RÜDINGER, Christian ROOS, Dr. Evelin WEISS, Roland DUDEK, Dr. Erich RODEK, and Georg-Friedrich SCHRÖDER and having Attorney Docket No. NHL-SCT-26 and having the title,"A cooking stove having a smooth-top glass ceramic cooktop with a glass ceramic cooktop cooking surface, method for production of stoves with smooth-top glass ceramic cooktop," and claiming priority from European patent Application 00114268.6, filed on Jul. 4, 2000, is hereby incorporated by reference as if set forth in its entirety herein.

The following U.S. Patents are to be incorporated by reference herein as follows: U.S. Pat. No. 6,021,774, having attorney docket No. NHL-SCT-01 US, having inventors Taplan et al., issued on Feb. 8, 2000, entitled,"Cooking unit, such as a stove, for cooking food"; U.S. Pat. No. 6,148,812, having attorney docket No. NHL-SCT-01-C-US, having inventors Taplan et al., issued on Nov. 21, 2000, entitled, "Cooking unit, such as a stove, for cooking food"; U.S. Pat. No. 6,002,112, having attorney docket No. NHL-SCT-03 US, having inventors NAβ et al., issued on Dec. 14, 1999, entitled,"Cooking appliance, such as a stove with a glass-ceramic hob or cooktop with a rapid cooking ring or hotplate"; U.S. Pat. No. 6,111,229, having attorney docket No. SCT-04 US, having inventor Schultheis, issued on Aug. 29, 2000, entitled,"Cooking appliance such as a stove with an arrangement of a ceramic heating element as cooking zone in a cutout of a cooking surface"; U.S. Pat. No. 6,050,176, having attorney docket No. SCT-05 US, having inventors Schultheis et al., issued on Apr. 18, 2000, entitled, "Arrangement of a hotplate in a cooktop; and U.S. Pat. No. 6,236,024, having attorney docket No. NHL-SCT-09 US, having inventors Gotz et al., issued on May 22, 2001, entitled, "Cooktop or stove having an arrangement of a one-piece molded part made of glass ceramic, glass or ceramic in the cooking surface area of the cooking unit in a cutout of a sill plate," are hereby incorporated by reference as if set forth in their entirety herein.

The following U.S. patent application is to be incorporated by reference as follows: U.S. patent application Ser. No. 09/522,460, entitled, "Cooking unite, such as a stove, for cooking food," having attorney docket No. NHL-SCT-10 US, having inventors Dipl.-Ing. Michael MUSKALLA, Keramik-Ing. Werner HOTTUM, and Dipl.-Ing. Bernd SCHULTHEIS, filed on Mar. 9, 2000 is hereby incorporated by reference as if set forth in its entirety herein.

A further foreign patent publication application, namely, Federal Republic of Germany Patent Application No. DE 199 10 467.0-16, corresponding to the U.S. application mentioned in the immediately preceding paragraph, filed on Mar. 10, 1999, [NHL-SCT-10] having inventors Dipl.-Ing. Michael MUSKALLA, Keramik-Ing. Werner HOTTUM, and Dipl.-Ing. Bernd SCHULTHEIS, and DE-OS 199 10 467.0-16 and DE-PS 199 10 467.0-16, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The following U.S. patent application is to be incorporated by reference as follows: U.S. patent application Ser. No. 09/758,953, entitled, "Stove or grill for cooking, and stove or grill for cooking having a glass ceramic cooktop or hob, and a glass ceramic plate cooktop or hob for use in a stove or grill," having attorney docket No. NHL-GAI-01 (SCT) US, having inventors Ioannis KOSMAS, Dietmar WENNEMANN, and Joachim GRUTZKE, filed on Jan. 11, 2001 is hereby incorporated by reference as if set forth in its entirety herein.

A further foreign patent publication application, namely, Federal Republic of Germany Patent Application No. DE 100 00 657.4-16, corresponding to the U.S. patent application referred to in the immediately preceding paragraph, filed on Jan. 11, 2000, [NHL-GAI-01 (SCT) US] having inventors Ioannis KOSMAS, Dietmar WENNEMANN, and Joachim GRUTZKE, entitled, "Glaskeramikplatte," and DE-OS 100 00 657 and DE-PS 100 00 657, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The following U.S. patent application is to be incorporated by reference as follows: U.S. patent application Ser. No. 09/866,989, entitled, "Method of treating a smooth-top kitchen ceramic or glass ceramic cooktop cooking surface of a smooth-top kitchen ceramic or glass ceramic cooktop or a stove having a ceramic or glass ceramic cooktop cooking surface, and a device therefor," having attorney docket No. NHL-GAI-02 (SCT) US, having inventors Bernd SCHULTHEIS and Monica DE WITZMANN, filed on May 29, 2001 is hereby incorporated by reference as if set forth in its entirety herein.

A further foreign patent publication application, namely, Federal Republic of Germany Patent Application No. DE 100 26 824.2-15, corresponding to the U.S. patent application referred to in the immediately preceding paragraph, filed on May 30, 2000, [NHL-GAI-02 (SCT) US] having inventors Bernd SCHULTHEIS and Monica DE WITZMANN, entitled, "Reinigungsschaber," and DE-OS 100 26 824 and DE-PS 100 26 824, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The following U.S. patents being of interest in connection with cooktops are to be incorporated by reference herein as follows: No. 6,024,084, having inventor Gerhardinger, issued on Feb. 15, 2000, entitled,"Double sided heat barrier glass with clear CVD coating and method of making the same"; No. 5,958,272, having inventors Taplan et al., issued on Sep. 28, 1999, entitled,"Cooktop with a glass or glass ceramic cooking surface"; and No. 4,413,171, having inventor Klammers, issued on Nov. 1, 1983, entitled,"Electric cooking oven for domestic use," are hereby incorporated by reference as if set forth in their entirety herein.

All of the references and documents, cited in any of the documents cited herein, and the references they are in turn cited in are hereby incorporated by reference as if set forth in their entirety herein. All of the documents cited herein, referred to in the immediately preceding sentence, include all of the patents, patent applications and publications cited anywhere in the present application. All of the references included herein as aforesaid include the corresponding equivalents published by the United States Patent and Trademark Office and elsewhere.

Some examples of stoves and ranges which may possibly be utilized or adapted for use in at least one possible embodiment of the present invention may be found in the following U.S. Pat.: No. 5,083,010, having inventors Henry et al., issued on Jan. 21, 1992; No. 4,601,279, having inventor Guerin, issued on Jul. 22, 1986; No. 4,493,976, having inventor Wilson, issued on Jan. 15, 1985; No. 4,292,501, having inventor Maitenaz, issued on Sep. 29, 1981; No. 5,213,091, issued on May 25, 1993; No. D336, 210, issued on Jun. 8, 1993; No. 5,280,152, issued on Jan. 18, 1994; No. 5,290,997, issued on Mar. 1, 1994; No. 5,400,765, issued on Mar. 28, 1995; No. D359,345, issued on Jun. 13, 1995; No. D361,015, issued on Aug. 8, 1995; and No. 5,464,005, issued on Nov. 7, 1995. The aforementioned patents are hereby incorporated by reference as if set forth in their entirety herein.

Some examples of oven glass, features of which may possibly be used or adapted for use in at least one possible embodiment of the present invention may be found in the following U.S. Pat. No. 4,014,312, issued to McKelvey et al. on Mar. 29, 1977; U.S. Pat. No. 4,084,571, issued to McFarland on Apr. 18, 1978; U.S. Pat. No. 4,206,338, issued to Katona on Jun. 3, 1980; U.S. Pat. No. 4,601,772, issued to McKelvey on Jul. 22, 1986; U.S. Pat. No. 4,898,147, issued to Domi et al. on Feb. 6, 1990; U.S. Pat. No. 4,951,652, issued to Ferrario et al. on Aug. 28, 1990; U.S. Pat. No. 5,441,036, issued to Mikalauskas, II et al. on Aug. 15, 1995; U.S. Pat. No. 6,024,084, issued to Gerhardinger on Feb. 15, 2000; U.S. Pat. No. 6,068,720, issued to McHugh on May 30, 2000; and U.S. Pat. No. 6,138,663, issued to Nomura et al. on Oct. 31, 2000. The aforementioned patents are hereby incorporated by reference as if set forth in their entirety herein.

Some examples of burners and related components which may possibly be utilized or adapted for use in at least one possible embodiment of the present invention may be found in the following U.S. Pat. No. 4,348,571, issued to Dills on Sep. 7, 1982 and entitled, "Flux shaping arrangement for induction surface unit"; U.S. Pat. No. 4,758,710, issued to Crossley et al. on Jul. 19, 1988 and entitled, "Heating apparatus"; U.S. Pat. No. 5,186,158, issued to Ferlin on Feb. 16, 1993 and entitled, "Gas burner"; U.S. Pat. No. 5,329, 918, issued to Di Bari on Jul. 19, 1994 and entitled, "Combined electric and gas burner"; U.S. Pat. No. 5,400, 765, issued to Goldstein et al. on Mar. 28, 1995 and entitled, "Selective emissive cooking stove". The aforementioned patents are hereby incorporated by reference as if set forth in their entirety herein.

Some examples of related components for stoves and ranges which may possibly be utilized or adapted for use in at least one possible embodiment of the present invention may be found in the following U.S. Pat. No. 5,220,155, issued to Cunningham on Jun. 15, 1993; U.S. Pat. No. 5,245,159, issued to Chang on Sep. 14, 1993; U.S. Pat. No. 5,343,020, issued to Waigand, et al. on Aug. 30, 1994; U.S. Pat. No. 5,377,660, issued to Bombardier on Jan. 3, 1995; U.S. Pat. No. 5,380,985, issued to Graham on Jan. 10, 1995; and U.S. Pat. No. 5,400,766, issued to Dillon on Mar. 28, 1995. The aforementioned patents are hereby incorporated by reference as if set forth in their entirety herein.

Some examples of cooking hobs and cooktops which may possibly be utilized or adapted for use in at least one possible embodiment of the present invention may be found in the following U.S. Pat. No. 5,406,932, issued to Joseph on Apr. 18, 1995; U.S. Pat. No. 5,422,460, issued to Bralia on Jun. 6, 1995; U.S. Pat. No. 5,424,512, issued to Turetta, et al. on Jun. 13, 1995; U.S. Pat. No. 5,425,353, issued to Herbert on Jun. 20, 1995; U.S. Pat. No. 5,429,114, issued to Taplan, et al. on Jul. 4, 1995; and U.S. Pat. No. 5,448,036, issued to Husslein on Sep. 5, 1995. The aforementioned patents are hereby incorporated by reference as if set forth in their entirety herein.

Examples of electric conducting coatings or layers, features of which may possibly be used with at least one possible embodiment of the present invention may be found in the following U.S. Pat. No. 4,109,562, issued to MacDonald on Aug. 29, 1978; U.S. Pat. No. 4,205,672, issued to Dvorak on Jun. 3, 1980; U.S. Pat. No. 4,302,309, issued to van der Heuvel on Nov. 24, 1981; U.S. Pat. No. 4,720,612, issued to Cummings on Jan. 19, 1988; U.S. Pat. No. 4,730,097, issued to Campbell, et al. on Mar. 8, 1988; U.S. Pat. No. 4,780,619, issued to Campbell, et al. on Oct. 25, 1988; U.S. Pat. No. 4,782,453, issued to Bauer, et al. on Nov. 1, 1988; U.S. Pat. No. 4,850,713, issued to Thery on Jul. 25, 1989; U.S. Pat. No. 4,947,053, issued to Campbell, et al. on Aug. 7, 1990; U.S. Pat. No. 4,950,972, issued to Berg on Aug. 21, 1990; U.S. Pat. No. 4,997,396, issued to Gold, et al. on Mar. 5, 1991; U.S. Pat. No. 5,072,098, issued to Matthews, et al. on Dec. 10, 1991; U.S. Pat. No. 5,399,121, issued to Gray, et al. on Mar. 21, 1995; U.S. Pat. No. 5,434,353, issued to Kraus on Jul. 18, 1995; U.S. Pat. No. 5,787,228, issued to Fiely, et al. on Jul. 28, 1998; U.S. Pat. No. 6,237,874, issued to Rutherford, et al. on May 29, 2001; and U.S. Pat. No. 6,279,856, issued to Rutherford, et al. on Aug. 28, 2001. All of the foregoing patents are hereby expressly incorporated by reference as if fully set forth in their entirety herein.

Some examples of continuous cleaning ovens, features of which may possibly be used or adapted for use in at least one possible embodiment of the present invention may be found in the following U.S. Pat. No. 4,009,795, issued to Hurko, et al. on Mar. 1, 1977; U.S. Pat. No. 4,071,738, issued to Jenn, et al. on Jan. 31, 1978; U.S. Pat. No. 4,455,319, issued to Clark on Jun. 19, 1984; U.S. Pat. No. 4,593,676, issued to Wackerman on Jun. 10, 1986; U.S. Pat. No. 5,013,366, issued to Jackson, et al. on May 7, 1991; and U.S. Pat. No. 5,849,106, issued to Bolden, et al. on Dec. 15, 1998. All of the foregoing patents are hereby expressly incorporated by reference as if fully set forth in their entirety herein.

Some examples of conductive enamel, features of which may possibly be used or adapted for use in a possible embodiment of the present invention may be found in the following U.S. Pat. No. 4,035,576, issued to Henry on Jul. 12, 1977; U.S. Pat. No. 4,413,788, issued to Schaefer, et al. on Nov. 8, 1983; U.S. Pat. No. 4,415,196, issued to Baum on Nov. 15, 1983; U.S. Pat. No. 4,505,538, issued to Toussaint on Mar. 19, 1985; U.S. Pat. No. 4,700,022, issued to Salvador, et al. on Oct. 13, 1987; U.S. Pat. No. 4,827,274, issued to Armbruster on May 2, 1989; U.S. Pat. No. 4,971,848, issued to Ruelle, et al. on Nov. 20, 1990; U.S. Pat. No. 5,051,560, issued to Fremaux, et al. on Sep. 24, 1991; U.S. Pat. No. 5,099,105, issued to Goerenz, et al. on Mar. 24, 1992; U.S. Pat. No. 5,605,591, issued to Beyrle, et al. on Feb. 25, 1997; U.S. Pat. No. 5,653,903, issued to Pinchok, et al. on Aug. 5, 1997.; U.S. Pat. No. 5,694,144, issued to Lefrou, et al. on Dec. 2, 1997; U.S. Pat. No. 5,824,993, issued to Chrysochoos, et al. on Oct. 20, 1998; and U.S. Pat. No. 5,877,473, issued to Koontz on Mar. 2, 1999. All of the foregoing patents are hereby expressly incorporated by reference as if fully set forth in their entirety herein.

Some examples of fluorine-doped zinc oxide, features of which may possibly be used or adapted for use in a possible embodiment of the present invention, may be found in the following U.S. Pat. No. 5,316,697, issued to Palmer, et al. on May 31, 1994; U.S. Pat. No. 5,483,247, issued to Adrian, et al. on Jan. 9, 1996; U.S. Pat. No. 5,679,283, issued to Tonar, et al. on Oct. 21, 1997; U.S. Pat. No. 5,888,431, issued to Tonar, et al. on mar. 30, 1999; U.S. Pat. No. 5,928,572, issued to Tonar, et al. on Jul. 27, 1999; U.S. Pat. No. 6,071,561, issued to Gordon, et al. on Jun. 6, 2000; U.S. Pat. No. 6,114,043, issued to Joret on Sep. 5, 2000; U.S. Pat. No. 6,174,599, issued to Boire, et al. on Jan. 16, 2001; and U.S. Pat. No. 6,248,263, issued to Tonar, et al. on Jun. 19, 2001. All of the foregoing patents are hereby expressly incorporated by reference as if fully set forth in their entirety herein.

Some examples of ceramic heating elements, features of which may possibly be used or adapted for use in a possible embodiment of the present invention, may be found in the following U.S. Pat. No. 4,489,232, issued to Wada, et al. on Dec. 18, 1984; U.S. Pat. No 4,855,570, issued to Wang on Aug. 8, 1989; U.S. Pat. No. 5,811,143, issued to Ingemanson on Sep. 22, 1998; U.S. Pat. No. 5,961,932, issued to Ghosh, et al. on Oct. 5, 1999; U.S. Pat. No. 5,965,051, issued to Hirayama et al. on Oct. 12, 1999; U.S. Pat. No. 5,998,765, issued to Mizuno, et al. on Dec. 7, 1999; U.S. Pat. No. 6,013,898, issued to Mizuno, et al. on Jan. 11, 2000; U.S. Pat. No. 6,025,579, issued to Tanaka, et al. on Feb. 15, 2000; U.S. Pat. No. 6,075,230, issued to Wilson on Jun. 13, 2000; U.S. Pat. No. 6,111,229, issued to Schultheis on Aug. 29, 2000; U.S. Pat. No. 6,123,791, issued to Han, et al. on Sep. 26, 2000; U.S. Pat. No. 6,130,410, issued to Kita on Oct. 10, 2000; and U.S. Pat. No. 6,143,239, issued to Sonntag on Nov. 7, 2000. All of the foregoing patents or publications are hereby expressly incorporated by reference as if fully set forth in their entirety herein.

Some examples of elements to heat glass, features of which may possibly be used or adapted for use in a possible embodiment of the present invention, may be found in the following U.S. Pat. No. 3,952,182, issued to Flanders on Apr. 20, 1976; U.S. Pat. No. 4,322,235, issued to Schwenninger on Mar. 30, 1982; U.S. Pat. No. 4,363,956, issued to Scheidler, et al. on Dec. 14, 1982; U.S. Pat. No. 4,538,051, issued to Schreder et al. on Aug. 27, 1985; U.S. Pat. No. 4,808,798, issued to Goessler, et al. on Feb. 28, 1989; U.S. Pat. No. 4,929,814, issued to Lisec on May 29, 1990; U.S. Pat. No. 5,778,689, issued to Beatenbough on Jul. 14, 1998; U.S. Pat. No. 5,930,459, issued to Eckman, et al. on Jul. 17, 1999; U.S. Pat. No. 5,977,523, issued to Scott on Nov. 2, 1999; U.S. Pat. No. 5,981,914, issued to Schultheis on Nov. 9, 1999; U.S. Pat. No. 6,124,576, issued to Zapf, et al. on Sep. 26, 2000; and U.S. Pat. No. 6,198,080, issued to Rice, et al. on Mar. 6, 2001. All of the foregoing patents are hereby expressly incorporated by reference as if fully set forth in their entirety herein.

Some examples of silicon containing heater elements, features of which may possibly be used or adapted for use in at least one possible embodiment of the present invention may be found in the following U.S. Pat. No. 4,010,352, issued to Phillips on Mar. 1, 1977; U.S. Pat. No. 4,336,216, issued to Watanabe, et al. on Jun. 22, 1982; U.S. Pat. No. 4,899,178, issued to Tellier on Feb. 6, 1990; U.S. Pat. No. 5,408,574, issued to Deevi, et al. on Apr. 18, 1995; U.S. Pat. No. 5,449,886, issued to Zhu, et al. on Sep. 12, 1995; U.S. Pat. No. 5,880,439, issued to Deevi, et al. on Mar. 9, 1999; U.S. Pat. No. 5,930,459, issued to Eckman, et al. on Jul. 27, 1999; U.S. Pat. No. 6,233,398, issued to Rutherford, et al. on May 15, 1999; U.S. Pat. No. 6,256,053, issued to Noshita on Jul. 3, 2001; and U.S. Pat. No. 6,280,682, issued to Sikka, et al. on Aug. 28, 2001. All of the foregoing patents are hereby expressly incorporated by reference as if fully set forth in their entirety herein.

Some examples of heating elements, features of which may possibly be used or adapted for use in a possible embodiment of the present invention, may be found in the following U.S. Pat. No. 4,071,739, issued to Jenn, et al. on Jan. 31, 1978; U.S. Pat. No. 4,120,646, issued to Groff, et al. on Oct. 17, 1978; U.S. Pat. No. 4,316,079, issued to Schmitz on Feb. 16, 1982; U.S. Pat. No. 4,464,563, issued to Jewett on Aug. 7, 1984; U.S. Pat. No. 4,775,777, issued to Sinn on Oct. 4, 1988; U.S. Pat. No. 5,154,160, issued to Burtea, et al. on Oct. 13, 1992; U.S. Pat. No. 5,449,886, issued to Zhu, et al. on Sep. 12, 1995; U.S. Pat. No. 5,812,411, issued to Calabrese, et al. on Sep. 22, 1998; U.S. Pat. No. 6,002,112, issued to Nass, et al. on Dec. 14, 1999; U.S. Pat. No. 6,021,774, issued to Taplan, et al. on Feb. 8, 2000; U.S. Pat. No. 6,050,176, issued to Schultheis, et al. on Apr. 18, 2000; and U.S. Pat. No. 6,148,812 issued to Taplan, et al. on Nov. 21, 2000. All of the foregoing patents are hereby expressly incorporated by reference as if fully set forth in their entirety herein.

Some examples of power supply arrangements, features of which may possibly be used or adapted for use in a possible embodiment of the present invention, may be found in the following U.S. Pat. No. 4,319,317, issued to Fukui, et al. on Mar. 9, 1982; U.S. Pat. No. 4,351,021, issued to Morihisa, et al. on Sep. 21, 1982; U.S. Pat. No. 4,459,467, issued to Bare, et al. on Jul. 10, 1984; U.S. Pat. No. 4,535,226, issued to Logel, et al. on Aug. 13, 1985; U.S. Pat. No. 5,005,123, issued to Mierzwinski on Apr. 2, 1991; U.S. Pat. No. 5,280,157, issued to Hornung on Jan. 18, 1994; U.S. Pat. No. 5,577,157, issued to Sopori on Nov. 19, 1996; U.S. Pat. No. 5,746,456, issued to Violi, et al. on May 5, 1998; U.S. Pat. No. 6,114,665, issued to Garcia, et al. on Sep. 5, 2000; U.S. Pat. No. 6,300,610, issued to Han, et al. on Oct. 9, 2001; and U.S. Pat. No. 6,303,059, issued to Foger, et al. on Oct. 16, 2001. All of the foregoing patents are hereby expressly incorporated by reference as if fully set forth in their entirety herein.

Some examples of sensors and switches, features of which may possibly be used or adapted for use in a possible embodiment of the present invention may be found in the following U.S. Pat. No. 5,379,023, issued to Dalton on Jan. 3, 1995; U.S. Pat. No. 5,453,589, issued to Mayer on Sep. 26, 1995; U.S. Pat. No. 5,453,590, issued to Mayer on Sep. 26, 1995; U.S. Pat. No. 5,378,865, issued to Reneau on Jan. 3, 1995; U.S. Pat. No. 5,408,132, issued to Fericean, et al. on Apr. 18, 1995; U.S. Pat. No. 5,428,253, issued to Ogata, et al. on Jun. 27, 1995; U.S. Pat. No. 5,442,150, issued to Ipcinski on Aug. 15, 1995; U.S. Pat. No. 5,430,421, issued to Bernard, et al. on Jul. 4, 1995; U.S. Pat. No. 5,444,295, issued Lake, et al. on Aug. 22, 1995; U.S. Pat. No. 5,607,611, issued to Lee on Mar. 4, 1997; and U.S. Pat. No. 6,229,129, issued to Yoshida on May 8, 2001. All of the foregoing patents are hereby expressly incorporated by reference as if fully set forth in their entirety herein.

Some examples of timers, features of which may possibly be used or adapted for use in a possible embodiment of the present invention may be found in the following U.S. Pat. No. 4,028,517, issued to Tanaka, et al. on Jun. 7, 1977; U.S. Pat. No. 4,975,555, issued to Braunisch, et al. on Dec. 4, 1990; U.S. Pat. No. 4,991,155, issued to Ken on Feb. 5, 1991; U.S. Pat. No. 5,073,390, issued to Knight, III, et al. on Dec. 17, 1991; U.S. Pat. No. 5,464,953, issued to Kim on Nov. 7, 1995; U.S. Pat. No. 5,598,947, issued to Smith on Feb. 4, 1997; U.S. Pat. No. 5,683,137, issued to McDonald, et al. on Nov. 4, 1997; U.S. Pat. No. 5,693,245, issued to Clizbe on Dec. 2, 1997; U.S. Pat. No. 5,694,831, issued to Haroun on Dec. 9, 1997; U.S. Pat. No. 5,917,779, issued to Ralson on Jun. 29, 1999; U.S. Pat. No. 5,948,305, issued to Petrides on Sep. 7, 1999; U.S. Pat. No. 6,060,698, issued to Petrides on May 9, 2000; and U.S. Pat. No. 6,140,621, issued to Ho, et al. on Oct. 31, 2000. All of the foregoing patents are hereby expressly incorporated by reference as if fully set forth in their entirety herein.

Some examples of self cleaning ovens or self-cleaning ovens, features of which may possibly be used or adapted for use in conjunction with at least one possible embodiment of the present invention may be found in the following U.S. Pat. No. 3,962,561, issued to Maitenaz on Jun. 8, 1976; U.S. Pat. No. 3,968,983, issued to Heit, et al. on Jul. 13, 1976; U.S. Pat. No. 4,013,312, issued to DeWeese on Mar. 22, 1977; U.S. Pat. No. 4,066,867, issued to Bechtel on Jan. 3, 1978; No. RE 29,602, issued to Perl on Apr. 4, 1978; U.S. Pat. No. 4,136,667, issued to Lewis on Jan. 30, 1979; U.S. Pat. No. 4,163,894, issued to Scherer on Aug. 7, 1979; U.S. Pat. No. 4,316,079, issued to Schmitz on Feb. 16, 1982; U.S. Pat. No. 4,340,806, issued to Bergquist on Jul. 20, 1982; U.S. Pat. No. 4,345,144, issued to Bergquist on Aug. 17, 1982; U.S. Pat. No. 6,232,584, issued to Meyer on May 15, 2001; and U.S. Pat. No. 6,285,290, issued to Koutznetsov on Sep. 4, 2001. All of the foregoing patents are hereby expressly incorporated by reference as if fully set forth in their entirety herein.

Some examples of resistive heating, features of which may possibly be used or adapted for use in conjunction with at least one possible embodiment of the present invention may be found in the following U.S. Pat. No. 4,233,497, issued to Lowell on Nov. 11, 1980; U.S. Pat. No. 4,267,433, issued to Sahm, III on May 12, 1981; U.S. Pat. No. 4,385,226, issued to Sauer on May 24, 1983; No. 4,443,691, issued to Sauer on Apr. 17, 1984; U.S. Pat. No. 4,453,669, issued to Karla, et al. on Jun. 12, 1984; U.S. Pat. No. 4,523,084, issued to Tamura, et al. on Jun. 11, 1985; U.S. Pat. No. 4,549,073, issued to Tamura, et al. on Oct. 22, 1985; U.S. Pat. No. 4,560,524, issued to Schmuckler on Dec. 24, 1985; U.S. Pat. No. 4,631,392, issued to O'Brien on Dec. 23, 1986; U.S. Pat. No. 4,668,857, issued to Schmuckler on May 26, 1987; U.S. Pat. No. 4,755,655, issued to Reiche, et al. on Jul. 5, 1988; U.S. Pat. No. 6,179,924, issued to Zhao, et al. on Jan. 30, 2001; U.S. Pat. No. 6,180,929, issued to Pearce on Jan. 30, 2001; U.S. Pat. No. 6,233,397, issued to Offir on May 15, 2001; and U.S. Pat. No. 6,290,879, issued to Duggal, et al. on Sep. 18, 2001. All of the foregoing patents are hereby expressly incorporated by reference as if fully set forth in their entirety herein.

Some examples of methods and apparatus for screen printing on glass substrates, features of which may possibly be used or adapted for use in conjunction with at least one possible embodiment of the present invention may be found in the following U.S. Pat. No. 4,420,501, issued to Ueda, et al. on Dec. 13, 1983; U.S. Pat. No. 4,549,484, issued to Neese on Oct. 29, 1985; U.S. Pat. No. 4,552,785, issued to Wartenberg on Nov. 12, 1985; U.S. Pat. No. 5,108,479, issued to Hirano on Apr. 28, 1992; U.S. Pat. No. 5,137,560, issued to Ohmura, et al. on Aug. 11, 1992; U.S. Pat. No. 5,193,457, issued to Hahn, et al. on Mar. 16, 1993; U.S. Pat. No. 5,198,154, issued to Yokoyama, et al. on Mar. 30, 1993 U.S. Pat. No. 5,273,780, issued to Borger, et al. on Dec. 28, 1993; U.S. Pat. No. 5,388,509, issued to Cutcher on Feb. 14, 1995; U.S. Pat. No. 5,415,731, issued to Kim on May 16, 1995; U.S. Pat. No. 5,608,373, issued to Martin on Mar. 4, 1997; U.S. Pat. No. 5,669,951, issued to Eichhorn on Sep. 23, 1997; U.S. Pat. No. 5,856,028, issued to Thimm on Jan. 5, 1999; U.S. Pat. No. 5,891,520, issued to Makar, et al. on Apr. 6, 1999; U.S. Pat. No. 5,927,191, issued to Wheatly, Jr., et al. on Jul. 27, 1999; and U.S. Pat. No. 6,077,564, issued to Thimm on Jun. 20, 2000. All of the foregoing patents are hereby expressly incorporated by reference as if fully set forth in their entirety herein.

Some examples of contacts and conductors, features of which may possibly be used or adapted for use in at least one possible embodiment of the invention may be found in the following U.S. Pat. No. 4,347,096, issued to Scorscher on Aug. 31, 1982; U.S. Pat. No. 4,416,497, issued to Brandsness, et al. on Nov. 22, 1983; U.S. Pat. No. 4,631,392, issued to O'Brien, et al. on Dec. 23, 1986; U.S. Pat. No. 4,691,426, issued to Roucek on Sep. 8, 1987; U.S. Pat. No. 4,795,885, issued to Driggers, et al. on Jan. 3, 1989; U.S. Pat. No. 4,803,544, issued to Holzschuh, et al. on Feb. 7, 1989; U.S. Pat. No. 4,816,089, issued to Cheng, et al. on Mar. 28, 1989; U.S. Pat. No. 4,820,358, issued to Chang on Apr. 11, 1989; U.S. Pat. No. 4,825,048, issued to Altmann, et al. on Apr. 25, 1989; U.S. Pat. No. 4,882,480, issued to Oba, et al. on Nov. 21, 1989; U.S. Pat. No. 5,281,488, issued to Poulsen on Jan. 25, 1994; U.S. Pat. No. 5,528,820, issued to Collier on Jun. 25, 1996; U.S. Pat. No. 5,557,374, issued to Chen on Sep. 17, 1996; U.S. Pat. No. 5,596,309, issued to Nabeshima, et al. on Jan. 21, 1997; and U.S. Pat. No. 5,796,059, issued to Boon on Aug. 18, 1998. All of the foregoing patents are hereby expressly incorporated by reference as if fully set forth in their entirety herein.

Some examples of adhesive contacts, features of which may possibly be used or adapted for use in a possible embodiment of the invention may be found in the following U.S. Pat. No. 4,045267, issued to Davis, et al. on Aug. 30, 1977; U.S. Pat. No. 4,542,040, issued to Nowak on Sep. 17, 1985; U.S. Pat. No. 4,633,508, issued to Sanders on Dec. 30, 1986; U.S. Pat. No. 5,442,386, issued to Childers, et al. on Aug. 15, 1995; U.S. Pat. No. 5,446,705, issued to Haas, et al. on Aug. 29, 1995; U.S. Pat. No. 5,638,835, issued to Franz, et al. on Jun. 17, 1997; U.S. Pat. No. 5,641,997, issued to Ohta, et al. on Jun. 24, 1997; U.S. Pat. No. 5,651,310, issued to Kempen on Jul. 29, 1997; U.S. Pat. No. 5,840,657, issued to Mehta, et al. on Nov. 24, 1998; and U.S. Pat. No. 6,224,711, issued to Carden, et al. on May 1, 2001. All of the foregoing patents are hereby expressly incorporated by reference as if fully set forth in their entirety herein.

Some examples of adhesive conductors, features of which may possibly be used or adapted for use in at least one possible embodiment of the invention may be found in the following U.S. Pat. No. 5,183,973, issued to Ingle, et al. on Feb. 2, 1993; U.S. Pat. No. 5,197,472, issued to DiSabito on Mar. 30, 1993; U.S. Pat. No. 5,261,021, issued to Pasta, et al. on Nov. 9, 1993; U.S. Pat. No. 5,353,195, issued to Fillion, et al. on Oct. 4, 1994; U.S. Pat. No. 5,388,790, issued to Guthke, et al. on Feb. 14, 1995; U.S. Pat. No. 5,417,584, issued to Knott on May 23, 1995; U.S. Pat. No. 5,455,383, issued to Tanaka on Oct. 3, 1995; U.S. Pat. No. 5,516,989, issued to Uedo, et al. on May 14, 1996; U.S. Pat. No. 5,804,768, issued to Sexton on Sep. 8, 1998; U.S. Pat. No. 5,807,141, issued to Sexton on Sep. 15, 1998; U.S. Pat. No. 5,899,774, issued to Sexton on May 4, 1999; U.S. Pat. No. 5,905,469, issued to Lindenmeyer on May 18, 1999; U.S. Pat. No. 5,954,909, issued to Davidsohn on Sep. 21, 1999; and U.S. Pat. No. 6,048,224, issued to Kay on Apr. 11, 2000. All of the foregoing patents are hereby expressly incorporated by reference as if fully set forth in their entirety herein.

Some examples of decorating and decorated glass, features of which may possibly be used or adapted for use in conjunction with at least one possible embodiment of the present invention may be found in the following U.S. Pat. No. 4,975,301, issued to Andrews, et al. on Dec. 4, 1990; U.S. Pat. No. 5,484,467, issued to Nass, et al. on Jan. 16, 1996; U.S. Pat. No. 5,500,255, issued to Leroux, et al. on Mar. 19, 1995; U.S. Pat. No. 5,501,910, issued to Smith on Mar. 26, 1996; U.S. Pat. No. 5,585,153, issued to Kamen on Dec. 17, 1996; U.S. Pat. No. 5,656,336, issued to Kamen, et al. on Aug. 12, 1997; U.S. Pat. No. 5,716,712, issued to Schonig on Feb. 10, 1998; U.S. Pat. No. 5,723,220, issued to Leroux, et al. on Mar. 3, 1998; U.S. Pat. No. 5,747,395, issued to Smith, et al. on May 5, 1998; U.S. Pat. No. 5,891,520, issued to Makar, et al. on Apr. 6, 1999; U.S. Pat. No. 5,922,271, issued to Semer, et al. on Jul. 13, 1999; U.S. Pat. No. 5,959,793, issued to Kellman-Turek on Sep. 28, 1999; U.S. Pat. No. 6,043,171, issued to Siebers, et al. on Mar. 28, 2000; U.S. Pat. No. 6,093,455, issued to Kamen, et al. on Jul. 25, 2000; U.S. Pat. No. 6,103,384, issued to Mario on Aug. 15, 2000; U.S. Pat. No. 6,105,394, issued to Sridharan on Aug. 22, 2000; U.S. Pat. No. 6,138,433, issued to Ridge on Oct. 31, 2000; U.S. Pat. No. 6,299,940, issued to Rapp on Oct. 9, 2001; U.S. Pat. No. 6,309,427, issued Korte on Oct. 30, 2001; and U.S. Pat. No. 6,311,523, issued to Kojima, et al. on Nov. 6, 2001. All of the foregoing patents are hereby expressly incorporated by reference as if fully set forth in their entirety herein.

Some examples of enamel decorating, features of which may possibly be used or adapted for use in conjunction with at least one possible embodiment of the present invention may be found in the following U.S. Pat. No. 4,959,256, issued to Piera on Sep. 25, 1990; U.S. Pat. No. 5,308,903, issued to Hegedus, et al. on May 3, 1994; U.S. Pat. No. 5,330,571, issued to Speer et al on Jul. 19, 1994; U.S. Pat. No. 5,605,869, issued to Mangat, et al. on Feb. 25, 1997; U.S. Pat. No. 5,633,090, issued to Rodek, et al. on May 27, 1997; U.S. Pat. No. 5,707,909, issued to Heitmann, et al. on Jan. 13, 1998; U.S. Pat. No. 5,747,395, issued to Smith, et al. on May 5, 1998; U.S. Pat. No. 5,800,869, issued to Piera on Sep. 1, 1998; U.S. Pat. No. 5,843,853, issued to Heitmann, et al. on Dec. 1, 1998; U.S. Pat. No. 5,849,649, issued to Poole on Dec. 15, 1998; U.S. Pat. No. 6,043,171, issued to Siebert, et al. on Mar. 28, 2000; U.S. Pat. No. 6,136,083, issued to Schmidt, et al. on Oct. 24, 2000; U.S. Pat. No. 6,270,854, issued to Schelling, et al. on Aug. 17, 2001; and U.S. Pat. No. 6,311,523, issued to Kojima, et al. on Nov. 6, 2001. All of the foregoing patents are hereby expressly incorporated by reference as if fully set forth in their entirety herein.

The following references, mentioned in the foregoing, are hereby incorporated by reference as if set forth in their entirety herein: U.S. Pat. No. 5,337,727, issued to Borens, et al. on Aug. 16, 1994; Federal Republic of Germany Petty Patent No. 299 22 756 U1 published on Apr. 13, 2000; Federal Republic of Germany Petty Patent No. 87 16 665 published on Mar. 24, 1988.

One feature of the invention resides broadly in a kitchen stove (10) for preparing food, such as, cooking, roasting, boiling, grilling, broiling, and baking food, said stove (10) comprising: a stove body (11); said stove body (11) being configured with a support (12) to support said stove body (11); at least one heating arrangement (13) to cook food; said at least one heating arrangement (13) being disposed atop said stove body (11); said at least one heating arrangement (13) comprising (i.), (ii.), and (iii.): (i.) an arrangement (14—FIG. 2) to receive a bottom of a cooking utensil (17); (ii.) at least one first heating element means (15) to cook food; and (iii.) a first apparatus (16) to select and set a heat setting of said at least one first heating element means (15); said at least one first heating element means (15) being disposed under said receiving arrangement (14) and being configured to pass heat through said receiving arrangement (14) to a bottom of a cooking utensil (17); said first heat setting apparatus (16) being configured to select and set a heat setting of said at least one first heating element means (15) at a heat sufficient to cook food; said stove body (11) being configured with a cooking oven (18); said cooking oven (18) being configured to cook, roast, boil, grill, broil, and bake food; said cooking oven (18) being configured with an interior (19) confined by walls (20) comprising top and bottom walls, side walls, a rear wall, and a front; a second heating arrangement (21) comprising (i.) and (ii.): (i.) at least one second heating element means (22) to cook food; and (ii.) a second apparatus (23) to select and set a heat setting of said at least one second heating element means (22); said at least one second heating element means (22) being disposed to heat said interior (19) of said cooking oven (18) and being configured to cook, roast, boil, grill, broil, and bake food; said second heat setting apparatus (23) being configured to select and set a heat setting of said second heating element means (22) to a heat sufficient to cook, roast, boil, grill, broil and bake food; a third heating arrangement (24) comprising (i.) and (ii.): (i.) a third heating element means (25); and (ii.) a third apparatus (26) to set a heat setting of said third heating element means (25); said third heating element means (25) being disposed to heat said interior (19) of said cooking oven (18) and being configured to heat said interior (19) of said cooking oven (18) to transform cooking residue, deposited in said interior (19) of said cooking oven (18) upon preparing food in said cooking oven (18), into ash; said third heat setting apparatus (26) being configured to set a heat setting of said third heating element means (25) at a sufficient heat for a time sufficient to transform cooking residue, deposited in said interior (19) of said cooking oven (18) upon preparing food in said cooking oven (18), into ash; said front comprising an oven door (27); said oven door (27) being configured to permit access to said interior (19) of said cooking oven (18); said oven door (27) comprising a window arrangement (28) configured with a viewing area (29) to view food being prepared in said cooking oven (18); said window arrangement (28) comprising (i.) and (ii.):(i.) a first door window pane (30); and (ii.) a second door window pane (31) disposed at a distance from said first door window pane (30); an arrangement (32) to maintain said first door window pane (30) disposed at a distance from said second door window pane (31); said first door window pane (30) becoming an inner door window pane upon closing of said oven door (27); said first door window pane (30) having a first, inner, surface (33) disposed towards said interior (19) of said cooking oven (18) upon closing of said oven door (27); said second door window pane (31) becoming an outer pane upon closing of said oven door (27); and a fourth heating arrangement (34) comprising (i.) and (ii.): (i.) a fourth heating element means (35); and (ii.) a fourth apparatus (36) to set a heat setting of said fourth heating element means (35); said fourth heating element means (35) being disposed on or in said first door window pane (30) and being configured to assist in heating by said third heating element means (25) of said first window pane (30); said fourth heating element means (35) further being disposed and configured to assist said third heating element means (25) to transform cooking residue, deposited on said first, inner, surface (33) of said first door window pane (30) upon preparing food in said cooking oven (18), into ash; said fourth heat setting apparatus (36) being configured to set a heat setting of said fourth heating element means (35) at a sufficient heat for a time sufficient to transform cooking residue, deposited on said first, inner, surface (33) of said first door window pane (30) upon preparing food in said cooking oven (18), into ash, thus at least to assist said third heating element means (25) to transform cooking residue on said first door window pane, into ash.

Another feature of the invention resides broadly in a kitchen stove (10) wherein: said first door window pane (30) comprises a second surface (37) opposite said first surface (33) of said first door window pane (30); and said fourth heating element means (35) comprises a layer (2); said layer (2) being configured of a material having portions through which said interior (19) of said cooking oven (18) can be viewed; said layer (2) being disposed on said second surface (37) of said first door window pane (30).

Yet another feature of the invention resides broadly in a kitchen stove (10) comprising one of (A.) and (B.): (A.) said second surface (37) of said first door window pane (30) comprises a central region (39) and a peripheral region **(39*a*); and said layer (2) being disposed substantially solely adjacent to said peripheral region (39*a*) of said second surface (37) of said first door window pane (30); and (B.) said layer (5) being disposed substantially fully over the entire second surface (37) of said first door window pane (30)**.

Still another feature of the invention resides broadly in a kitchen stove (10) wherein: said layer (2, 5) comprises a transparent material.

A further feature of the invention resides broadly in an oven (40) for preparing food, said oven (40) comprising: an oven body (41); said oven body (41) being configured with an interior (42) confined by walls (43) comprising top and bottom walls, side walls, a rear wall, and a front; said front comprising an oven door (44); said oven door (44) being configured to permit access to said interior (42) of said oven (40); said oven door (44) comprising a window arrangement (45) configured with a viewing area (46) to view food being prepared in said oven (40); said window arrangement (45) comprising at least one door window pane (47); said at least one door window pane (47) comprising a first door window pane (47); said first door window pane (47) becoming an inner door window pane (47) upon closing of said oven door (44); said first door window pane (47) having a first, inner, surface (48) disposed towards said interior (42) of said oven (40) upon closing of said oven door (44); a first heating arrangement (49) comprising (i.) and (ii.): (i.) at least one first heating element means (50) to prepare food; and (ii.) a first apparatus (51) to select and set a heat setting of said first heating element means (50); said at least one first heating element means (50) being configured to prepare food by being disposed to heat said interior (42) of said oven (40); said first setting apparatus (51) being configured to select and set a heat setting of said first heating element means (50) to a temperature sufficient to prepare food; a second heating arrangement (52) comprising (i.) and (ii.): (i.) a second heating element means (53); and (ii.) a second apparatus (54) to set a heat setting of said second heating element means (53); said second heating element means (53) being disposed to heat said interior (42) of said oven (40) and being configured to heat said interior (42) of said oven (40) to transform cooking residue, deposited in said interior (42) of said oven (40) upon preparing food in said oven (40), into ash; said second heat setting apparatus (54) being configured to set a heat setting of said second heating element means (53) at a sufficient heat for a time sufficient to transform cooking residue, deposited in said interior (42) of said oven (40) upon preparing food in said oven (40), into ash; and a third heating arrangement (55) comprising (i.) and (ii.): (i.) a third heating element means (56); and (ii.) a third apparatus (57) to set a heat setting of said third heating element means (56); said third heating element means (56) being disposed on, in, or substantially adjacent to said first door window pane (47) and being configured to assist in heating by said second heating element means (53) of said first door window pane (47); said third heating element means (56) further being disposed and configured to assist said second heating element means (53) to transform cooking residue, deposited on said first, inner, surface (48) of said first door window pane (47) upon preparing food in said oven (40), into ash; said third heat setting apparatus (57) being configured to set a heat setting of said third heating element means (56) at a sufficient heat for a time sufficient to transform cooking residue, deposited on said first, inner, surface (48) of said first door window pane (47) upon preparing food in said oven (40), into ash, thus at least to assist said second heating element means (53) to transform cooking residue ash on said first door window pane (47), into ash.

Another feature of the invention resides broadly in an oven (40) wherein: said first door window pane (47) comprises a second surface (58) opposite said first, inner, surface (48) of said first door window pane (47); and said third heating element (56) comprises a layer (59); said layer (59) being configured of a material having portions through which the interior of said oven can be viewed; said layer (59) being disposed on said second surface (58) of said first door window pane (47).

Yet another feature of the invention resides broadly in an oven (40) comprising one of (A.) and (B.): (A.) said second surface (58) of said first door window pane (47) comprises a central region (39) and a peripheral region (39*a*); and said layer (59) being disposed substantially solely adjacent to said peripheral region (39*a*) of said second surface (58) of said first Ag door window pane (47); and (B.) said layer (5, 59) being disposed substantially fully over the entire second surface (58) of said first door window pane (47).

Still another feature of the invention resides broadly in an oven (40) wherein: said layer (2, 5, 59) comprises a transparent material.

A further feature of the invention resides broadly in an oven (40) comprising at least one of (A.), (B.), (C.), (D.), (E.), and (F.): (A.) said first door window pane (47) comprises a second surface (93) opposite said first, inner, surface (48) of said first door window pane (47); and said third heating element means (56) comprises a layer (94); said layer (94) being configured of a material having portions through which said interior (42) of said oven (40) can be viewed; said layer (94) being disposed on said second surface (93) of said first door window pane (47); (B.) said second surface (93) of said first door window pane (47) comprises a central region (39) and a peripheral region (39*a*); and said layer (94) being disposed substantially solely adjacent to said peripheral region (39*a*) of said second surface (93) of said first door window pane (47); (C.) said layer (5, 94) being disposed substantially fully (FIG. 15) over the entire second surface (93) of said first door window pane (47); (D.) said layer (94) comprises a transparent material (FIG. 4); (E.) one of: (i.), (ii.), (iii.), (iv.), (v.), (vi.), and (vii.): (i.) said first door window pane (47) comprises one of: (a.) and (b.): (a.) a transparent pane (FIG. 9); and (b.) a pane comprising one of (1.) and (2.): (1.) temperature-resistant glass; and (2.) temperature-resistant glass ceramic; (ii.) said layer (94) comprising an electric heating arrangement (FIG. 11); (iii.) said layer (94) comprising a resistive layer being configured to be heated by a source of power (3); (iv.) strip conductors (6) being configured to connect said layer (94) to a source of power (3); said strip conductors (6) being disposed at said peripheral region (39*a*) of said second surface (93) of said first door window pane (47); said strip conductors (6) comprising one of (a.), (b.), and (c.): (a.) contact strips (95, FIG. 13) to connect said layer (94) to a source of power (3); (b.) contacts to connect said layer (94) to a source of power (3); said contacts comprising resilient contacts pressed onto said first door window pane (47); (c.) cables, schematically represented by reference numeral 95, to connect said layer (94) to a source of power (3); said cables comprising cables soldered onto said first door window pane (47); (v.) said layer (94) being disposed away from said peripheral region (39*a*) of said second surface (93) to provide a space (4) through which said interior (42) of said oven (40) can be viewed; (vi.) said layer (94) comprising a patterned layer (FIG. 13) to provide a decoration on said first door window pane (47); and (vii.) said layer (94) comprising a conductive, resistive enamel layer being configured to be heated as electric heating arrangement;(F.) said third heating element means (56) comprises one of (a.) and (b.): (a.) a resilient metallic heating element (35, FIG. 2) configured to be pressed-on to said first door window pane (47); and (b.) a ceramic heating element (55*a*, FIG. 6) configured to be pressed-on to said first door window pane (47).

Another feature of the invention resides broadly in an oven (40) comprising all of (A.), (B.), and (C.): (A.) one of (i.), (ii.), (iii.), and (iv.): (i.) said first door window pane (47) comprises a second surface (93) opposite said first, inner, surface (48) of said first door window pane (47); and said third heating element means (56) comprises a layer (94); said layer (94) being configured of a material having portions through which said interior (42) of said oven (40) can be viewed; said layer (94) being disposed on said second surface (93) of said first door window pane (47); (ii.) said third heating element means (56) comprises one of (a.) and (b.): (a.) a resilient metallic heating element (35, FIG. 2) configured to be pressed-on to said first door window pane (47) and (b.) a ceramic heating element (55*a*, FIG. 6) configured to be pressed-on to said first door window pane (47); (iii.) said second surface (93) of said first door window pane (47) comprises a central region (39) and a peripheral region (39*a*); and said layer (94) being disposed substantially solely adjacent to said peripheral region (39*a*) of said second surface (93) of said first door window pane (47); and (iv.) said layer (5, 94) being disposed substantially fully (FIG. 15) over the entire second surface (93) of said first door window pane (47); (B.) said layer (94) comprises a transparent material (FIG. 4); and (C.) one of: (i.), (ii.), (iii.), (iv.), (v.), (vi.), and (vii.): (i.) said first door window pane (47) comprises one of: (a.) and (b.): (a.) a transparent pane (FIG. 9); and (b.) a pane comprising one of (1.) and (2.): (1.) temperature-resistant glass; and (2.) temperature-resistant glass ceramic; (ii.) said layer (94) comprising an electric heating arrangement (FIG. 11); (iii.) said layer (94) comprising a resistive layer being configured to be heated by a source of power (3); (iv.) strip conductors (6) being configured to connect said layer (94) to a source of power (3); said strip conductors (6) being disposed at said peripheral region (39*a*) of said second surface (93) of said first door window pane (47); said strip conductors (6) comprising one of (a.), (b.), and (c.): (a.) contact strips (95, FIG. 13) to connect said layer (94) to a source of power (3); (b.) contacts to connect said layer (94) to a source of power (3); said contacts comprising resilient contacts pressed onto said first door window pane (47); (c.) cables to connect said layer (94) to a source of power (3); said cables comprising cables soldered onto said first door window pane (47); (v.) said layer (94) being disposed away from said peripheral region (39*a*) of said second surface (93) to provide a space (4) through which said interior (42) of said oven (40) can be viewed; (vi.) said layer (94) comprising a patterned layer (FIG. 13) to provide a decoration on said first door window pane (47); and (vii.) said layer (94) comprising a conductive, resistive enamel layer being configured to be heated as electric heating arrangement.

Yet another feature of the invention resides broadly in a method of cleaning an oven (60) for preparing food, said oven (60) comprising: an oven body (61); said oven body (61) being configured with an interior (62) confined by walls (63) comprising top and bottom walls, side walls, a rear wall, and a front; said front comprising an oven door (64); said oven door (64) being configured to permit access to said interior (62) of said oven (60); said oven door (64) comprising a window arrangement (65) configured with a viewing area (66) to view food being prepared in said oven (60); said window arrangement (65) comprising at least one door window pane (67); said at least one door window pane (67) comprising a first door window pane (67); said first door window pane (67) becoming an inner door window pane (67) upon closing of said oven door (64); said first door window pane (67) having a first, inner, surface (68) disposed towards said interior (62) of said oven (60) upon closing of said oven door (64); at least one first heating arrangement (69) comprising (i.) and (ii.): (i.) at least one first heating element means (70); and (ii.) a first apparatus (71) to select and set at least two heat settings of said at least one first heating element means (70); said at least one first heating element means (70) being disposed to heat said interior (62) of said oven (60); said at least one first heating element means (70) being configured to prepare food, and being configured to heat said interior (62) of said oven (60) to transform cooking residue, deposited in said interior (62) of said oven (60) upon preparing food in said oven (60), into ash; said first heat setting apparatus means (71) being configured to select and set a heat setting of said first heating element means (70) to a temperature sufficient to prepare food, and further being configured to set a heat setting of said first heating element means (70) at a sufficient temperature for a time sufficient to transform cooking residue, deposited in said interior (62) of said oven (60) upon preparing food in said oven (60), into ash; and a second heating arrangement (75) comprising (i.) and (ii.): (i.) a second heating element means (76); and (ii.) a second apparatus means (74) to set a heat setting of said second heating element means (76); said second heating element means (73) being disposed on, in, or sufficiently adjacent to said inner door window pane (67) and being configured to assist in heating by said first heating element means (70) to transform cooking residue, deposited on said first, inner, surface (68) of said first door window pane (67); said second heating element means (76) being configured to assist said first heating element means (70) in the heating of said first door window pane (67) to transform cooking residue, deposited on said first, inner, surface (68) of said first door window pane (67) upon preparing food in said oven (60), into ash; said second heat setting apparatus means (74) being configured to set a heat setting of said first heating element means (70) at a sufficient temperature for a time sufficient to transform cooking residue, deposited on said first, inner, surface (68) of said first door window pane (67) upon preparing food in said oven (60), into ash, to thus assist said first heating element means (70) in the heating of said first door window pane (67) to transform cooking residue into ash on said first door window pane (67); said method comprising the steps of: disposing food in said interior (62) of said oven (60); preparing food in said oven (60); removing prepared food from said oven (60); depositing a first, cooking, residue on said walls (63) of said oven (60) and on said first, inner, surface (68) of said first door window pane (67); setting said first heat setting apparatus means (71) to a temperature sufficient to transform said first, cooking, residue, deposited in said interior (62) of said oven (60) upon the cooking of food, into a second, converted, residue more readily removable from said interior (62) of said oven (60) than said first, cooking, residue; setting said second heat setting apparatus means (74) to a temperature sufficient to assist said first heating element means (70) to transform said first, cooking, residue, deposited on said first, inner, surface (68) of said first door window pane (67) upon the cooking of food, into a second, converted, residue more readily removable from said first, inner, surface (68) of said first door window pane (67) than said first, cooking, residue; and removing the second, converted, residue from said first, inner, surface (68) of said first door window pane (67).

Still another feature of the invention resides broadly in a method of cleaning an oven (80) for preparing food, said oven (80) comprising: an oven structure (81); said oven structure (81) being configured to prepare food; said oven structure (81) comprising an oven body (82) being configured with an interior (83) confined by walls (84) comprising top and bottom walls, side walls, a rear wall, and a front; said front comprising an oven door (85); said oven door (85) being configured to permit access to said interior (83) of said oven (80); said oven door (85) comprising a window arrangement (86) configured with a viewing area (87) to view food being prepared in said oven (80); said window arrangement (86) comprising at least one door window pane (88); said at least one door window pane (88) comprising a first door window pane (88); said first door window pane (88) having a first, inner, surface (89) disposed towards and in said interior (83) of said oven (80) upon closing of said oven door (85); and a heating arrangement (90) comprising (i.) and (ii.): (i.) a heating element means (91); and (ii.) an apparatus means (92) to to set a heat setting of said heating element means (91); said heating element means (91) being disposed on, in, or sufficiently adjacent to said first door window pane (88) to heat said first door window pane (88); said heating element means (91) being configured to heat said first door window pane (88) to transform a first, cooking, residue, deposited on said first, inner, surface (89)

of said first door window pane (88) upon preparing food in said oven (80), into a second, converted, residue; said heat setting apparatus means (92) being configured to set a heat setting of said heating element means (91) at a sufficient heat for a time sufficient to transform the first, cooking, residue, deposited on said first, inner, surface (89) of said first door window pane (88) upon preparing food in said oven (80), into the second, converted, residue; said method comprising the steps of: disposing food in said interior (83) of said oven (80); preparing food in said oven (80); depositing a first, cooking, residue from cooked food on said first, inner, surface (89) of said first door window pane (88); removing prepared food from said oven (80); setting said heat setting apparatus means (92) to a heat sufficient to transform the first, cooking, residue, deposited on said first, inner, surface (89) of said first door window pane (88) upon preparing food, into a second, converted, cooking residue more readily removable from said interior (83) of said oven (80) than the first, cooking, residue; setting said heat setting apparatus means (92) to a heat sufficient to transform the first, cooking, residue, deposited on said first, inner, surface (89) of said first door window pane (88) upon preparing food, into a second, converted, cooking residue more readily removable from said first, inner, surface (89) of said first door window pane (88) than the first, cooking, residue; and removing the second, converted, cooking residue from said first, inner, surface (89) of said first door window pane (88).

A further feature of the invention resides broadly in a method wherein: said first door window pane (88) comprises a second surface (93) opposite said first, inner, surface (89) of said first door window pane (88); and said heating element means (91) comprises a layer (94); said layer (94) being configured of a material having portions through which said interior (83) of said oven (80) can be viewed; said layer (94) being disposed on said second surface (93) of said first door window pane (88).

Another feature of the invention resides broadly in a method wherein: said second surface (93) of said first door window pane (88) comprises a central region (39) and a peripheral region (39*a*); and said layer (94) being disposed substantially solely adjacent to said peripheral region (39*a*) of said second surface (93) of said first door window pane (88).

Yet another feature of the invention resides broadly in a method wherein: said layer (5, 94) being disposed substantially fully (FIG. 15) over the entire second surface (93) of said first door window pane (88).

Still another feature of the invention resides broadly in a method according wherein: said layer (94) comprises a transparent material (FIG. 4).

A further feature of the invention resides broadly in a method comprising one of: (i.), (ii.), (iii.), (iv.), (v.), (vi.), and (vii.): (i.) said first door window pane (88) comprises one of: (a.) and (b.): (a.) a transparent pane (FIG. 9); and (b.) a pane comprising one of (1.) and (2.): (1.) temperature-resistant glass; and (2.) temperature-resistant glass ceramic; (ii.) said layer (94) comprising an electric heating arrangement (FIG. 11); (iii.) said layer (94) comprising a resistive layer being configured to be heated by a source of power (3); (iv.) strip conductors (6) being configured to connect said layer (94) to a source of power (3); said strip conductors (6) being disposed at said peripheral region (39*a*) of said second surface (93) of said first door window pane (88); said strip conductors (6) comprising one of (a.), (b.), and (c.): (a.) contact strips (95, FIG. 13) to connect said layer (94) to a source of power (3); (b.) contacts to connect said layer (94) to a source of power (3); said contacts comprising resilient contacts pressed onto said first door window pane (88); (c.) cables to connect said layer (94) to a source of power (3); said cables comprising cables soldered onto said first door window pane (88); (v.) said layer (94) being disposed away from said peripheral region (39*a*) of said second surface (93) to provide a space (4) through which said interior (83) of said oven (80) can be viewed; (vi.) said layer (94) comprising a patterned layer (FIG. 13) to provide a decoration on said first door window pane (88); and (vii.) said layer (94) comprising a conductive, resistive enamel layer being configured to be heated as electric heating arrangement.

Another feature of the invention resides broadly in a method wherein: said heating element means (91) comprises one of (a.) and (b.): (a.) a resilient metallic heating element (35, FIG. 2) configured to be pressed-on to said first door window pane (88); and (b.) a ceramic heating element (55*a*, FIG. 6) configured to be pressed-on to said first door window pane (88). Yet another feature of the invention resides broadly in a method comprising at least one of (A.), (B.), (C.), (D.), (E.), and (F.): (A.) said first door window pane (88) comprises a second surface (93) opposite said first, inner, surface (89) of said first door window pane (88); and said heating element means (91) comprises a layer (94); said layer (94) being configured of a material having portions through which said interior (83) of said oven (80) can be viewed; said layer (94) being disposed on said second surface (93) of said first door window pane (88); (B.) said second surface (93) of said first door window pane (88) comprises a central region (39) and a peripheral region (39*a*); and said layer (94) being disposed substantially solely adjacent hi>to said peripheral region (39*a*) of said second surface (93) of said first door window pane (88); (C.) said layer (5, 94) being disposed substantially fully (FIG. 15) over the entire second surface (93) of said first door window pane (88); (D.) said layer (94) comprises a transparent material (FIG. 4); (E.) one of: (i.), (ii.), (iii.), (iv.), (v.), (vi.), and (vii.): (i.) said first door window pane (88) comprises one of: (a.) and (b.): (a.) a transparent pane (FIG. 9); and (b.) a pane comprising one of (1.) and (2.): (1.) temperature-resistant glass; and (2.) temperature-resistant glass ceramic; (ii.) said layer (94) comprising an electric heating arrangement (FIG. 11); (iii.) said layer (94) comprising a resistive layer being configured to be heated by a source of power (3); (iv.) strip conductors (6) being configured to connect said layer (94) to a source of power (3); said strip conductors (6) being disposed at said peripheral region (39*a*) of said second surface (93) of said first door window pane (88); said strip conductors (6) comprising one of (a.), (b.), and (c.): (a.) contact strips (95, FIG. 13) to connect said layer (94) to a source of power (3); (b.) contacts to connect said layer (94) to a source of power (3); said contacts comprising resilient contacts pressed onto said first door window pane (88); (c.) cables to connect said layer (94) to a source of power (3); said cables comprising cables soldered onto said first door window pane (88); (v.) said layer (94) being disposed away from said peripheral region (39*a*) of said second surface (93) to provide a space (4) through which said interior (83) of said oven (80) can be viewed; (vi.) said layer (94) comprising a patterned layer (FIG. 13) to provide a decoration on said first door window pane (88); and (vii.) said layer (94) comprising a conductive, resistive enamel layer being configured to be heated as electric heating arrangement; (F.) said heating element means (91) comprises one of (a.) and (b.): (a.) a resilient metallic heating element (35, FIG. 2) configured to be pressed-on to said first door window pane (88); and (b.) a ceramic heating element (55*a*, FIG. 6) configured to be pressed-on to said first door window pane (88).

Still another feature of the invention resides in a method comprising all of (A.), (B.), and (C.): (A.) one of (i.), (ii.), (iii.), and (iv.): (i.) said first door window pane (88) comprises a second surface (93) opposite said first, inner, surface (89) of said first door window pane (88); and said heating element means (91) comprises a layer (94); said layer (94) being configured of a material having portions through which said interior (83) of said oven (80) can be viewed; said layer (94) being disposed on said second surface (93) of said first door window pane (88); (ii.) said heating element means (91) comprises one of (a.) and (b.): (a.) a resilient metallic heating element (35, FIG. 2) configured to be pressed-on to said first door window pane (88); and (b.) a ceramic heating element (55*a*,FIG. 6) configured to be pressed-on to said first door window pane (88); (iii.) said second surface (93) of said first door window pane (88) comprises a central region (39) and a peripheral region (39*a*); and said layer (94) being disposed substantially solely adjacent to said peripheral region (39*a*) of said second surface (93) of said first door window pane (88); and (iv.) said layer (5, 94) being disposed substantially fully (FIG. 15) over the entire second surface (93) of said first door window pane (88); (B.) said layer (94) comprises a transparent material (FIG. 4); and (C.) one of: (i.), (ii.), (iii.), (iv.), (v.), (vi.), and (vii.): (i.) said first door window pane (88) comprises one of: (a.) and (b.): (a.) a transparent pane (FIG. 9); and (b.) a pane comprising one of (1.) and (2.): (I.) temperature-resistant glass; and (2.) temperature-resistant glass ceramic; (ii.) said layer (94) comprising an electric heating arrangement (FIG. 11); (iii.) said layer (94) comprising a resistive layer being configured to be heated by a source of power (3); (iv.) strip conductors (6) being configured to connect said layer (94) to a source of power (3); said strip conductors (6) being disposed at said peripheral region (39*a*) of said second surface (93) of said first door window pane (88); said strip conductors (6) comprising one of (a.), (b.), and (c.): (a.) contact strips (95, FIG. 13) to connect said layer (94) to a source of power (3); (b.) contacts to connect said layer (94) to a source of power (3); said contacts comprising resilient contacts pressed onto said first door window pane (88); (c.) cables to connect said layer (94) to a source of power (3); said cables comprising cables soldered onto said first door window pane (88);(v.) said layer (94) being disposed away from said peripheral region (39*a*) of said second surface (93) to provide a space (4) through which said interior (83) of said oven (80) can be viewed; (vi.) said layer (94) comprising a patterned layer (FIG. 13) to provide a decoration on said first door window pane (88); and (vii.) said layer (94) comprising a conductive, resistive enamel layer being configured to be heated as electric heating arrangement.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

What is claimed is:

1. A kitchen stove for preparing food, such as, cooking, roasting, boiling, grilling, broiling, and baking food, said stove comprising:

a stove body;

said stove body being configured with a support to support said stove body;

at least one heating arrangement to cook food;

said at least one heating arrangement being disposed atop said stove body;

said at least one heating arrangement comprising (i), (ii), and (iii):

(i) an arrangement to receive a bottom of a cooking utensil;

(ii) at least one first heating element means to cook food; and (iii) a first apparatus to select and set a heat setting of said at least one first heating element means;

said at least one first heating element means being disposed under said receiving arrangement and being configured to pass heat through said receiving arrangement to a bottom of a cooking utensil;

said first heat setting apparatus being configured to select and set a heat setting of said at least one first heating element means at a heat sufficient to cook food;

said stove body being configured with a cooking oven;

said cooking oven being configured to cook, roast, boil, grill, broil, and bake food;

said cooking oven being configured with an interior confined by walls comprising top and bottom walls, side walls, a rear wall, and a front;

a second heating arrangement comprising (i) and (ii):

(i) at least one second heating element means to cook food; and (ii) a second apparatus to select and set a heat setting of said at least one second heating element means;

said at least one second heating element means being disposed to heat said interior of said cooking oven and being configured to cook, roast, boil, grill, broil, and bake food;

said second heat setting apparatus being configured to select and set a heat setting of said second heating element means to a heat sufficient to cook, roast, boil, grill, broil and bake food;

a third heating arrangement comprising (i) and (ii):

(i) a third heating element means; and (ii) a third apparatus to set a heat setting of said third heating element means;

said third heating element means being disposed to heat said interior of said cooking oven and being configured to heat said interior of said cooking oven to transform cooking residue, deposited in said interior of said cooking oven upon preparing food in said cooking oven, into ash;

said third heat setting apparatus being configured to set a heat setting of said third heating element means at a sufficient heat for a time sufficient to transform cooking residue, deposited in said interior of said cooking oven upon preparing food in said cooking oven, into ash;

said front comprising an oven door;

said oven door being configured to permit access to said interior of said cooking oven;

said oven door comprising a window arrangement configured with a viewing area to view food being prepared in said cooking oven;

said window arrangement comprising (i) and (ii):

(i) a first door window pane; and (ii) a second door window pane disposed at a distance from said first door window pane;

an arrangement to maintain said first door window pane disposed at a distance from said second door window pane;

said first door window pane becoming an inner door window pane upon closing of said oven door;

said first door window pane having a first, inner, surface disposed towards said interior of said cooking oven upon closing of said oven door;

said second door window pane becoming an outer pane upon closing of said oven door; and a fourth heating arrangement comprising (i) and (ii):

(i) a fourth heating element means; and (ii) a fourth apparatus to set a heat setting of said fourth heating element means;

said heating element means being disposed on or in said first door window pane and being configured to assist in heating by said third heating element means of said first window pane;

said fourth heating element means further being disposed and configured to assist said third heating element means to transform cooking residue, deposited on said first, inner, surface of said first door window pane upon preparing food in said cooking oven, into ash;

said fourth heat setting apparatus being configured to set a heat setting of said fourth heating element means at a sufficient heat for a time sufficient to transform cooking residue, deposited on said first, inner, surface of said first door window pane (30) upon preparing food in said cooking oven, into ash, thus at least to assist said third heating element means to transform cooking residue on said first door window pane, into ash.

2. The kitchen stove according to claim 1, wherein:

said first door window pane comprises a second surface opposite said first surface of said first door window pane; and said fourth heating element means comprises a layer;

said layer being configured of a material having portions through which said interior of said cooking oven can be viewed;

said layer being disposed on said second surface of said first door window pane.

3. The kitchen stove according to claim 2, comprising one of (A.) and (B.):

(A.) said second surface of said first door window pane comprises a central region and a peripheral region; and said layer being disposed substantially solely adjacent to said peripheral region of said second surface of said first door window pane; and (B.) said layer being disposed substantially fully over the entire second surface of said first door window pane.

4. The kitchen stove according to claim 3, wherein:

said layer comprises a transparent material.

5. An oven for preparing food, said oven comprising:

an oven body;

said oven body being configured with an interior confined by walls comprising top and bottom walls, side walls, a rear wall, and a front;

said front comprising an oven door;

said oven door being configured to permit access to said interior of said oven;

said oven door comprising a window arrangement configured with a viewing area to view food being prepared in said oven;

said window arrangement comprising at least one door window pane;

said at least one door window pane comprising a first door window pane;

said first door window pane becoming an inner door window pane upon closing of said oven door;

said first door window pane having a first, inner, surface disposed towards said interior of said oven upon closing of said oven door;

a first heating arrangement comprising (i.) and (ii.):

(i.) at least one first heating element means to prepare food; and (ii.) a first apparatus to select and set a heat setting of said first heating element means;

said at least one first heating element means being configured to prepare food by being disposed to heat said interior of said oven;

said first setting apparatus being configured to select and set a heat setting of said first heating element means to a temperature sufficient to prepare food;

a second heating arrangement comprising (i.) and (ii.):

(i.) a second heating element means; and (ii.) a second apparatus to set a heat setting of said second heating element means;

said second heating element means being disposed to heat said interior of said oven and being configured to heat said interior of said oven to transform cooking residue, deposited in said interior of said oven upon preparing food in said oven, into ash;

said second heat setting apparatus being configured to set a heat setting of said second heating element means at a sufficient heat for a time sufficient to transform cooking residue, deposited in said interior of said oven upon preparing food in said oven, into ash; and a third heating arrangement comprising (i.) and (ii.):

(i.) a third heating element means; and (ii.) a third apparatus to set a heat setting of said third heating element means;

said third heating element means being disposed on, in, or substantially adjacent to said first door window pane and being configured to assist in heating by said second heating element means of said first door window pane;

said third heating element means further being disposed and configured to assist said second heating element means to transform cooking residue, deposited on said first, inner, surface of said first door window pane upon preparing food in said oven, into ash;

said third heat setting apparatus being configured to set a heat setting of said third heating element means at a sufficient heat for a time sufficient to transform cooking residue, deposited on said first, inner, surface of said first door window pane upon preparing food in said oven, into ash, thus at least to assist said second heating element means to transform cooking residue ash on said first door window pane, into ash.

6. The oven according to claim 5, wherein:

said first door window pane comprises a second surface opposite said first, inner, surface of said first door window pane; and said third heating element comprises a layer;

said layer being configured of a material having portions through which the interior of said oven can be viewed;

said layer being disposed on said second surface of said first door window pane.

7. The oven according to claim 6, comprising one of (A.) and (B.):

(A.) said second surface of said first door window pane comprises a central region and a peripheral region; and said layer being disposed substantially solely adjacent to said peripheral region of said second surface of said first door window pane; and (B.) said layer being disposed substantially fully over the entire second surface of said first door window pane.

8. The oven according to claim 7, wherein:

said layer comprises a transparent material.

9. The oven according to claim 5, comprising at least one of (A.), (B.), (C.), (D.), (E.), and (F.):

(A.) said first door window pane comprises a second surface opposite said first, inner, surface of said first door window pane; and said third heating element means comprises a layer; said layer being configured of a material having portions through which said interior of said oven can be viewed; said layer being disposed on said second surface of said first door window pane;

(B.) said second surface of said first door window pane comprises a central region and a peripheral region; and said layer being disposed substantially solely adjacent to said peripheral region of said second surface of said first door window pane;

(C.) said layer being disposed substantially fully over the entire second surface of said first door window pane;

(D.) said layer comprises a transparent material;

(E.) one of: (i.), (ii.), (iii.),(iv.), (v.), (vi.), and (vii.):

(i.) said first door window pane comprises one of (a.) and (a.) a transparent pane; and (b.) a pane comprising one of (1.) and (2.):

(1.) temperature-resistant glass; and (2.) temperature-resistant glass ceramic;

(ii.) said layer comprising an electric heating arrangement;

(iii.) said layer comprising a resistive layer being configured to be heated by a source of power;

(iv.) strip conductors being configured to connect said layer to a source of power; said strip conductors of (iv.) being disposed at said peripheral region of said second surface of said first door window pane; said strip conductors of (iv.) comprising one of (a.), (b.), and (c.):

(a.) contact strips to connect said layer to a source of power;

(b.) contacts to connect said layer to a source of power; said contacts comprising resilient contacts pressed onto said first door window pane;

(c.) cables to connect said layer to a source of power; said cables comprising cables soldered onto said first door window pane;

(v.) said layer being disposed away from said peripheral region of said second surface to provide a space through which said interior of said oven can be viewed;

(vi.) said layer comprising a patterned layer to provide a decoration on said first door window pane; and (vi.) said layer comprising a conductive, resistive enamel layer being configured to be heated as electric heating arrangement;

(F.) said third heating element means comprises one of (a.) and (b.):

(a.) a resilient metallic heating element configured to be pressed-on to said first door window pane; and (b.) a ceramic heating element configured to be pressed-on to said first door window pane.

10. The oven according to claim 5, comprising all of (A.), (B.), and (C.):

(A.) one of (i.), (ii.), (iii.), and (iv.):

(i.) said first door window pane comprises a second surface opposite said first, inner, surface of said first door window pane; and said third heating element means comprises a layer; said layer being configured of a material having portions through which said interior of said oven can be viewed; said layer being disposed on said second surface of said first door window pane;

(ii.) said third heating element means comprises one of (a.) and (b.):

(a.) a resilient metallic heating element configured to be pressed-on to said first door window pane; and (b.) a ceramic heating element configured to be pressed-on to said first door window pane;

(iii.) said second surface of said first door window pane comprises a central region and a peripheral region; and said layer being disposed substantially solely adjacent to said peripheral region of said second surface of said first door window pane; and (iv.) said layer being disposed substantially fully over the entire second surface of said first door window pane;

(B.) said layer comprises a transparent material; and (C.) one of: (i.), (ii.), (iii.), (iv.), (v.), (vi.), and (vii.):

(i.) said first door window pane comprises one of: (a.) and (b.):

(a.) a transparent pane; and (b.) a pane comprising one of (1.) and (2.):

(1.) temperature-resistant glass; and (2.) temperature-resistant glass ceramic;

(ii.) said layer comprising an electric heating arrangement;

(iii.) said layer comprising a resistive layer being configured to be heated by a source of power;

(iv.) strip conductors being configured to connect said layer to a source of power; said strip conductors of (iv.) being disposed at said peripheral region of said second surface of said first door window pane; said strip conductors of (iv.) comprising one of (a.), (b.), and (c.):

(a.) contact strips to connect said layer to a source of power;

(b.) contacts to connect said layer to a source of power; said contacts comprising resilient contacts pressed onto said first door window pane;

(c.) cables to connect said layer to a source of power; said cables comprising cables soldered onto said first door window pane;

(v.) said layer being disposed away from said peripheral region of said second surface to provide a space through which said interior of said oven can be viewed;

(vi.) said layer comprising a patterned layer to provide a decoration on said first door window pane; and (vii.) said layer comprising a conductive, resistive enamel layer being configured to be heated as electric heating arrangement.

11. A method of cleaning an oven for preparing food, said oven comprising:

an oven body;

said oven body being configured with an interior confined by walls comprising top and bottom walls, side walls, a rear wall, and a front;

said front comprising an oven door;

said oven door being configured to permit access to said interior of said oven;

said oven door comprising a window arrangement configured with a viewing area to view food being prepared in said oven;

said window arrangement comprising at least one door window pane;

said at least one door window pane comprising a first door window pane;

said first door window pane becoming an inner door window pane upon closing of said oven door;

said first door window pane having a first, inner, surface disposed towards said interior of said oven upon closing of said oven door;

at least one first heating arrangement comprising (i.) and (ii .) :

(i.) at least one first heating element means; and (ii.) a first apparatus to select and set at least two heat settings of said at least one first heating element means;

said at least one first heating element means being disposed to heat said interior of said oven;

said at least one first heating element means being configured to prepare food, and being configured to heat said interior of said oven to transform cooking residue, deposited in said interior of said oven upon preparing food in said oven, into ash;

said first heat setting apparatus means being configured to select and set a heat setting of said first heating element means to a temperature sufficient to prepare food, and further being configured to set a heat setting of said first heating element means at a sufficient temperature for a time sufficient to transform cooking residue, deposited in said interior of said oven upon preparing food in said oven, into ash; and a second heating arrangement comprising (i.) and (ii.):

(i.) a second heating element means; and (ii.) a second apparatus means to set a heat setting of said second heating element means;

said second heating element means being disposed on, in, or sufficiently adjacent to said inner door window pane and being configured to assist in heating by said first heating element means to transform cooking residue, deposited on said first, inner, surface of said first door window pane;

said second heating element means being configured to assist said first heating element means in the heating of said first door window pane to transform cooking residue, deposited on said first, inner, surface of said first door window pane upon preparing food in said oven, into ash;

said second heat setting apparatus means being configured to set a heat setting of said first heating element means at a sufficient temperature for a time sufficient to transform cooking residue, deposited on said first, inner, surface of said first door window pane upon preparing food in said oven, into ash, to thus assist said first heating element means in the heating of said first door window pane to transform cooking residue into ash on said first door window pane;

said method comprising the steps of:

disposing food in said interior of said oven;

preparing food in said oven;

removing prepared food from said oven;

depositing a first, cooking, residue on said walls of said Dooven and on said first, inner, surface of said first door window pane;

setting said first heat setting apparatus means to a temperature sufficient to transform said first, cooking, residue, deposited in said interior of said oven upon the cooking of food, into a second, converted, residue more readily removable from said interior of said oven than said first, cooking, residue;

setting said second heat setting apparatus means to a temperature sufficient to assist said first heating element means to transform said first, cooking, residue, deposited on said first, inner, surface of said first door window pane upon the cooking of food, into a second, converted, residue more readily removable from said first, inner, surface of said first door window pane than said first, cooking, residue; and removing the second, converted, residue from said first, inner, surface of said first door window pane.

12. A method of cleaning an oven for preparing food, said oven comprising:

an oven structure;

said oven structure being configured to prepare food;

said oven structure comprising an oven body being configured with an interior confined by walls comprising top and bottom walls, side walls, a rear wall, and a front;

said front comprising an oven door;

said oven door being configured to permit access to said interior of said oven;

said oven door comprising a window arrangement configured with a viewing area to view food being prepared in said oven;

said window arrangement comprising at least one door window pane;

said at least one door window pane comprising a first door window pane;

said first door window pane having a first, inner, surface disposed towards and in said interior of said oven upon closing of said oven door; and a heating arrangement comprising (i.) and (ii.):

(i.) a heating element means; and (ii.) an apparatus means to set a heat setting of said heating element means;

said heating element means being disposed on, in, or sufficiently adjacent to said first door window pane to heat said first door window pane;

said heating element means being configured to heat said first door window pane to transform a first, cooking, residue, deposited on said first, inner, surface of said first door window pane upon preparing food in said oven, into a second, converted, residue;

said heat setting apparatus means being configured to set a heat setting of said heating element means at a sufficient heat for a time sufficient to transform the first, cooking, residue, deposited on said first, inner, surface of said first door window pane upon preparing food in said oven, into the second, converted, residue;

said method comprising the steps of:

disposing food in said interior of said oven;

preparing food in said oven;

depositing a first, cooking, residue from cooked food on said first, inner, surface of said first door window pane;

removing prepared food from said oven;

setting said heat setting apparatus means to a heat sufficient to transform the first, cooking, residue, deposited on said first, inner, surface of said first door window pane upon preparing food, into a second, converted, cooking residue more readily removable from said interior of said oven than the first, cooking, residue;

setting said heat setting apparatus means to a heat sufficient to transform the first, cooking, residue, deposited on said first, inner, surface of said first door window pane upon preparing food, into a second, converted, cooking residue more readily removable from said first, inner, surface of said first door window pane than the first, cooking, residue; and removing the second, converted, cooking residue from said first, inner, surface of said first door window pane.

13. The method according to claim 12, wherein:

said first door window pane comprises a second surface opposite said first, inner, surface of said first door window pane; and said heating element means comprises a layer;

said layer being configured of a material having portions through which said interior of said oven can be viewed;

said layer being disposed on said second surface of said first door window pane.

14. The method according to claim 13, wherein:

said second surface of said first door window pane comprises a central region and a peripheral region; and said layer being disposed substantially solely adjacent to said peripheral region of said second surface of said first door window pane.

15. The method according to claim 13, wherein:

said layer being disposed substantially fully over the entire second surface of said first door window pane.

16. The method according to claim 14, wherein:

said layer comprises a transparent material.

17. The method according to claim 16, comprising one of: (i.), (ii.), (iii.), (iv.), (v.), (vi.), and (vii.):

(i.) said first door window pane comprises one of: (a.) and (b.) :

(a.) a transparent pane; and (b.) a pane comprising one of (1.) and (2.):

(1.) temperature-resistant glass; and (2.) temperature-resistant glass ceramic;

(ii.) said layer comprising an electric heating arrangement;

(iii.) said layer comprising a resistive layer being configured to be heated by a source of power;

(iv.) strip conductors being configured to connect said layer to a source of power; said strip conductors of (iv.) being disposed at said peripheral region of said second surface of said first door window pane; said strip conductors of (iv.) comprising one of (a.), (b.), and (c.):

(a.) contact strips to connect said layer to a source of power;

(b.) contacts to connect said layer to a source of power; said contacts comprising resilient contacts pressed onto said first door window pane;

(c.) cables to connect said layer to a source of power; said cables comprising cables soldered onto said first door window pane;

(v.) said layer being disposed away from said peripheral region of said second surface to provide a space through which said interior of said oven can be viewed;

(vi.) said layer comprising a patterned layer to provide a decoration on said first door window pane; and (vii.) said layer comprising a conductive, resistive enamel layer being configured to be heated as electric heating arrangement.

18. The method according to claim 12, wherein:

said heating element means comprises one of (a.) and (b.):

(a.) a resilient metallic heating element configured to be pressed-on to said first door window pane; and (b.) a ceramic heating element configured to be pressed-on to said first door window pane.

19. The method according to claim 12, comprising at least one of (A.), (B.), (C.), (D.), (E.), and (F.):

(A. said first door window pane comprises a second surface opposite said first, inner, surface of said first door window pane; and said heating element means comprises a layer; said layer being configured of a material having portions through which said interior of said oven can be viewed; said layer being disposed on said second surface of said first door window pane;

(B.) said second surface of said first door window pane comprises a central region and a peripheral region; and said layer being disposed substantially solely adjacent to said peripheral region of said second surface of said first door window pane;

(C.) said layer being disposed substantially fully over the entire second surface of said first door window pane;

(D.) said layer comprises a transparent material;

(E.) one of: (i.), (ii.), (iii.), (iv.), (v.), (vi.), and (vii.):

(i.) said first door window pane comprises one of (a.) and (b.):

(a.) a transparent pane; and (b.) a pane comprising one of (1.) and (2.):

(1.) temperature-resistant glass; and (2.) temperature-resistant glass ceramic;

(ii.) said layer comprising an electric heating arrangement;

(iii.) said layer comprising a resistive layer being configured to be heated by a source of power;

(iv.) strip conductors being configured to connect said layer to a source of power; said strip conductors of (iv.) being disposed at said peripheral region of said second surface of said first door window pane; said strip conductors of (iv.) comprising one of (a.), (b.), and (c.):

(a.) contact strips to connect said layer to a source of power;

(b.) contacts to connect said layer to a source of power; said contacts comprising resilient contacts pressed onto said first door window pane;

(c.) cables to connect said layer to a source of power; said cables comprising cables soldered onto said first door window pane;

(v.) said layer being disposed away from said peripheral region of said second surface to provide a space through which said interior of said oven can be viewed;

(vi.) said layer comprising a patterned layer to provide a decoration on said first door window pane; and (vii.) said layer comprising a conductive, resistive enamel layer being configured to be heated as electric heating arrangement;

(F.) said heating element means comprises one of (a.) and (b.):

(a.) a resilient metallic heating element configured to be pressed-on to said first door window pane; and (b.) a ceramic heating element configured to be pressed-on to said first door window pane.

20. The method according to claim 12, comprising all of (A.), (B.), and (C.):

(A.) one of (i.), (ii.), (iii.), and (iv.):

(i.) said first door window pane comprises a second surface opposite said first, inner, surface of said first door window pane; and said heating element means comprises a layer; said layer being configured of a material having portions through which said interior of said oven can be viewed; said layer being disposed on said second surface of said first door window pane;

(ii.) said heating element means comprises one of (a.) and (b.):

(a.) a resilient metallic heating element configured to be pressed-on to said first door window pane; and (b.) a ceramic heating element configured to be pressed-on to said first door window pane;

(iii.) said second surface of said first door window pane comprises a central region and a peripheral region; and said layer being disposed substantially solely adjacent to said peripheral region of said second surface of said first door window pane; and (iv.) said layer being disposed substantially fully over the entire second surface of said first door window pane;

(B.) said layer comprises a transparent material; and (C.) one of: (i.), (ii.), (iii.), (iv.), (v.), (vi.), and (vii.):

(i.) said first door window pane comprises one of (a.) and (b.):

(a.) a transparent pane; and (b.) a pane comprising one of (1.) and (2.):

(1.) temperature-resistant glass; and (2.) temperature-resistant glass ceramic;

(ii.) said layer comprising an electric heating arrangement;

(iii.) said layer comprising a resistive layer being configured to be heated by a source of power;

(iv.) strip conductors being configured to connect said layer to a source of power; said strip conductors of (iv.) being disposed at said peripheral region of said second surface of said first door window pane; said strip conductors of (iv.) comprising one of (a.), (b.), and (c.):

(a.) contact strips to connect said layer to a source of power;

(b.) contacts to connect said layer to a source of power; said contacts comprising resilient contacts pressed onto said first door window pane;

(c.) cables to connect said layer to a source of power; said cables comprising cables soldered onto said first door window pane;

(v.) said layer being disposed away from said peripheral region of said second surface to provide a space through which said interior of said oven can be viewed;

(vi.) said layer comprising a patterned layer to provide a go decoration on said first door window pane; and (vii.) said layer comprising a conductive, resistive enamel layer being configured to be heated as electric heating arrangement.

* * * * *

UNITED STATES PATENT AND TRADEMARK OFFICE

CERTIFICATE OF CORRECTION

PATENT NO. : 6,570,135 B2
DATED : May 27, 2003
INVENTOR(S) : Oliver Gros and Peter Nass It is certified that error appears in the above-identified patent and that said Letters Patent is hereby corrected as shown below:

Column 16,
Line 27, after "arrangement," delete "*".

Column 18,
Line 11, after the first occurrence of "and", delete "DE-SO" and insert -- DE-OS --.

Column 29,
Line 55, after "first" delete "Ag".

Column 34,
Line 31, after "adjacent", delete "hi>to" and insert -- to --.

Column 37,
Line 20, after "said" insert -- fourth --.

Column 42,
Line 6, before "and", delete "Dooven" and insert -- oven --.

Column 46,
Line 30, after "a" delete "go".

Signed and Sealed this

Seventh Day of October, 2003

JAMES E. ROGAN
*Director of the United States Patent and Trademark Office*